US009828735B2

(12) United States Patent
Yuki et al.

(10) Patent No.: US 9,828,735 B2
(45) Date of Patent: Nov. 28, 2017

(54) SNOW REMOVAL MACHINE

(71) Applicant: HONDA MOTOR CO., LTD., Tokyo (JP)

(72) Inventors: Toru Yuki, Wako (JP); Jun Fukano, Wako (JP); Shinsaku Nakayama, Wako (JP); Yoshihisa Hirose, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 5 days.

(21) Appl. No.: 15/018,431

(22) Filed: Feb. 8, 2016

(65) Prior Publication Data

US 2016/0244925 A1 Aug. 25, 2016

(30) Foreign Application Priority Data

Feb. 25, 2015 (JP) ..... 2015-035715

(51) Int. Cl.
*E01H 5/04* (2006.01)

(52) U.S. Cl.
CPC ..... *E01H 5/045* (2013.01)

(58) Field of Classification Search
CPC ..... E01H 5/045
See application file for complete search history.

(56) References Cited

U.S. PATENT DOCUMENTS

2014/0180478 A1* 6/2014 Letsky ..... E01H 5/098 700/258
2014/0202047 A1 7/2014 Kawakami et al.

FOREIGN PATENT DOCUMENTS

EP 2615210 A2 * 7/2013 ..... E01H 5/045
EP 2757198 7/2014
JP H02-136122 11/1990

OTHER PUBLICATIONS

European Search Report dated Jul. 27, 2016, 7 pages.

* cited by examiner

*Primary Examiner* — Calvin Cheung
(74) *Attorney, Agent, or Firm* — Rankin, Hill & Clark LLP

(57) ABSTRACT

Disclosed is a snow removal machine capable of adjusting a snow throwing direction of a snow throwing section by means of a snow throwing drive section, which comprises: a snow throwing direction sensor for detecting a snow throwing direction of the snow throwing section; a snow removal machine inclination angle sensor for detecting an inclination angle of the snow removal machine or the snow throwing section relative to a horizontal surface; and a control section that controls the snow throwing drive section to adjust the snow throwing direction of the snow throwing section based on respective detection values of the snow throwing direction detected by the snow throwing direction sensor and the inclination angle detected by the snow removal machine inclination angle sensor.

7 Claims, 19 Drawing Sheets

SNOW REMOVAL MACHINE

FIELD OF THE INVENTION

The present invention relates to snow removal machines where a snow throwing direction of a snow throwing section is adjustable via a snow-throwing drive section.

BACKGROUND OF THE INVENTION

Among the conventionally-known snow removal machines are snow removal machines which include a snow discharge member (snow blade) provided on a front section of a machine body, and auger type snow removal machines which throw accumulated snow by means of a snow throwing section. The auger type snow removal machines gather accumulated snow by means of an auger provided on a front section while traveling forward and can throw away the gathered snow by a blower through a chute. A chute guide, which is a vertically pivotable member for adjusting a snow throwing angle in a vertical or up-down direction, is provided on a distal end portion of the chute. The chute and the chute guide are components of the snow throwing section.

In ordinary auger type snow removal machines, a human operator adjusts a snow throwing direction and snow throwing distance of the chute in accordance with situations of an area where snow removal work is to be performed. If a place to which snow is to be thrown (snow throwing place) is large, the human operator does not have to frequently adjust the chute and the chute guide. However, if the snow throwing place is small, or if the thrown snow is to be gathered in one place, the human operator has to frequently adjust the chute and the chute guide, and such frequent adjusting operation is very bothersome. Besides, because the human operator has to frequently adjust the snow throwing direction while moving the snow removal machine forward, the adjusting operation would become a great burden on the human operator.

In view of the above, a technique for automatically adjusting the snow throwing direction of the chute and the chute guide in accordance with a traveled distance of the snow removal machine with a view to gathering thrown snow in one place is proposed in Japanese Utility Model Application Laid-open publication No. HEI-2-136122. In the snow removal machine disclosed in the HEI-2-136122 publication, a human operator first operates the chute and the chute guide to set a target snow throwing position by operating the chute and the chute guide, and then a control section automatically adjusts the snow throwing direction of the chute and the chute guide in such a manner as to maintain the target snow throwing position. More specifically, the control section adjusts the snow throwing direction of the chute and the chute guide on the basis of respective angles of the chute and the chute guide, traveled distance of the snow removal machine and a steering angle of a steering handle of the machine.

The ground surface on which to perform snow removal work is not always horizontal, and thus, the snow removal machine may sometimes perform the snow removal work while traveling on a sloping surface. As the snow removal machine itself inclines, the snow throwing direction of the chute and the chute guide too varies. Thus, even if the control section automatically adjusts the snow throwing direction of the chute and the chute guide, thrown snow cannot be gathered in one place. Therefore, a further improvement is yet to be made in order to alleviate the burden on the human operator.

SUMMARY OF THE INVENTION

In view of the foregoing prior art problems, it is an object of the present invention to provide an improved snow removal technique which can automatically adjust a snow throwing direction in accordance with topographical (land shape) variation of an area on which to perform snow removal work.

In order to accomplish the above-mentioned object, the present invention provides an improved snow removal machine capable of adjusting a snow throwing direction of a snow throwing section by means of a snow throwing drive section, which comprises: a snow throwing direction sensor for detecting a snow throwing direction of the snow throwing section; a snow removal machine inclination angle sensor for detecting an inclination angle of the snow removal machine or the snow throwing section relative to a horizontal surface; and a control section that controls the snow throwing drive section to adjust the snow throwing direction of the snow throwing section based on respective detection values of the snow throwing direction detected by the snow throwing direction sensor and the inclination angle detected by the snow removal machine inclination angle sensor. The above-mentioned horizontal surface is defined, for example, by a preset horizontal flat surface (reference surface).

With the aforementioned arrangements of the present invention, the snow throwing direction of the snow throwing section can be automatically adjusted with the inclination angle of the snow removal machine itself or the snow throwing section of the snow removal machine detected by the snow removal machine inclination angle sensor. Thus, the snow throwing direction of the snow throwing section can be automatically adjusted in accordance with topographical (land shape) variation of an area where snow removal work is to be performed. For example, where snow thrown by the snow throwing section is to be gathered in one place by automatically adjusting the snow throwing direction of the snow throwing section inclination angle in accordance with a traveled distance of the snow removal machine, the thrown snow can be gathered in one place as desired by accurate automatic adjustment of the snow throwing direction of the snow throwing section. In this way, the present invention can effectively alleviate the burden on the human operator of the snow removal machine.

Preferably, in the snow removal machine of the invention, the snow throwing drive section comprises a chute guide pivotable in a vertical or up-down direction for adjusting a snow throwing angle in the up-down direction, the snow throwing drive section comprises a guide drive section for pivotally driving the chute guide in the up-down direction, the snow throwing direction sensor comprises a guide angle sensor for detecting an inclination angle, in the up-down direction, of the chute guide, and the control section controls the guide drive section to adjust the pivoting angle, in the up-down direction, of the chute guide based on respective detection values of the inclination angle, in the up-down direction, of the chute guide detected by the guide angle sensor and the inclination angle detected by the snow removal machine inclination angle sensor.

With the aforementioned arrangements of the present invention, the inclination angle, in the vertical or up-down direction, of the chute guide can be automatically adjusted with the inclination angle of the snow removal machine or the snow throwing section of the snow removal machine detected by the snow removal machine inclination angle sensor. Thus, the inclination angle, in the up-down direction, of the chute guide can be automatically adjusted in accordance with topographical variation of an area where snow removal work is to be performed. For example, where the thrown snow is to be gathered in one place by accurately automatically adjusting the inclination angle, in the up-down direction, of the chute guide in accordance with the traveled distance of the snow removal machine, the thrown snow can be gathered in one place as desired by accurate automatic adjustment of the snow throwing direction of the snow throwing section. In this way, the present invention can effectively alleviate the burden on the human operator of the snow removal machine.

Further, preferably, the snow throwing section comprises a chute pivotable for adjusting the snow throwing direction, the snow throwing drive section comprises a chute drive section for pivotally driving the chute, the snow throwing direction sensor comprises a chute angle sensor for detecting a pivoting angle of the chute, and the control section controls the chute drive section to adjust the pivoting angle of the chute based on respective detection values of the pivoting angle of the chute detected by the chute angle sensor and the inclination angle detected by the snow removal machine inclination angle sensor.

With the aforementioned arrangements of the present invention, the pivoting angle of the chute can be automatically adjusted with the inclination angle of the snow removal machine or the snow throwing section of the snow removal machine detected by the snow removal machine inclination angle sensor. Thus, the pivoting angle of the chute can be automatically adjusted in accordance with topographical variation of an area where snow removal work is to be performed. For example, where the thrown snow is to be gathered in one place by accurately automatically adjusting the inclination angle of the chute in accordance with the traveled distance of the snow removal machine, the thrown snow can be gathered in one place as desired by accurate automatic adjustment of the snow throwing direction of the snow throwing section. In this way, the present invention can effectively alleviate the burden on the human operator of the snow removal machine.

Further, preferably, the snow throwing section comprises a chute pivotable for adjusting the snow throwing direction and a chute guide pivotable in an up-down direction for adjusting a snow throwing angle in the up-down direction, the snow throwing drive section comprises a chute drive section for pivotally driving the chute and a guide drive section for pivotally driving the chute guide, the snow throwing direction sensor comprises a chute angle sensor for detecting a pivoting angle of the chute and a guide angle sensor for detecting an inclination angle, in the up-down direction, of the chute guide, and the control section not only controls the chute drive section to adjust the pivoting angle of the chute based on respective detection values of the pivoting angle of the chute detected by the chute angle sensor and the inclination angle detected by the snow removal machine inclination angle sensor, but also controls the guide drive section to adjust the pivoting angle, in the up-down direction, of the chute guide based on respective detection values of the inclination angle, in the up-down direction, of the chute guide detected by the guide angle sensor and the inclination angle detected by the snow removal machine inclination angle sensor.

With the aforementioned arrangements of the present invention, the inclination angle of the chute and the inclination angle, in the up-down direction, of the chute guide can be automatically adjusted with the inclination angle of the snow removal machine or the snow throwing section of the snow removal machine detected by the snow removal machine inclination angle sensor. Thus, the inclination angle of the chute and the inclination angle, in the up-down direction, of the chute guide can be automatically adjusted in accordance with topographical variation of an area where snow removal work is to be performed. For example, where the thrown snow is to be gathered in one place by accurately automatically adjusting the inclination angle of the chute and the inclination angle, in the up-down direction, of the chute guide in accordance with the traveled distance of the snow removal machine, the thrown snow can be gathered in one place as desired by accurate automatic adjustment of the snow throwing direction of the snow throwing section. In this way, the present invention can effectively alleviate the burden on the human operator of the snow removal machine.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE INVENTION

In the following description, the terms "front", "rear", "left", "right", "up", "down", etc. are used to refer to directions as viewed from a human operator operating a snow removal machine of the present invention.

First Embodiment

Figure 1:
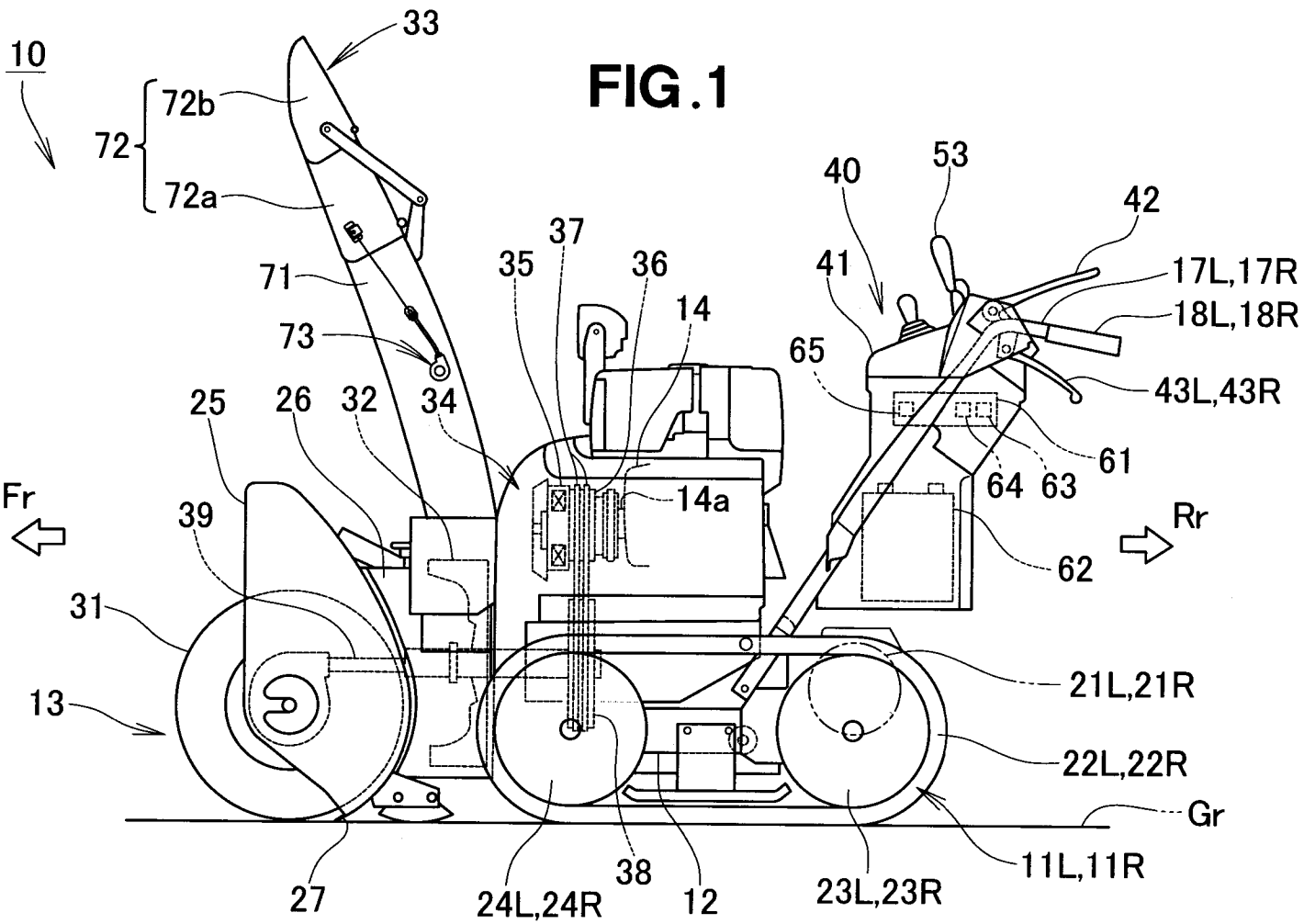
FIG. 1 is a side view showing a first embodiment of a snow removal machine of the present invention.
Figure 2:
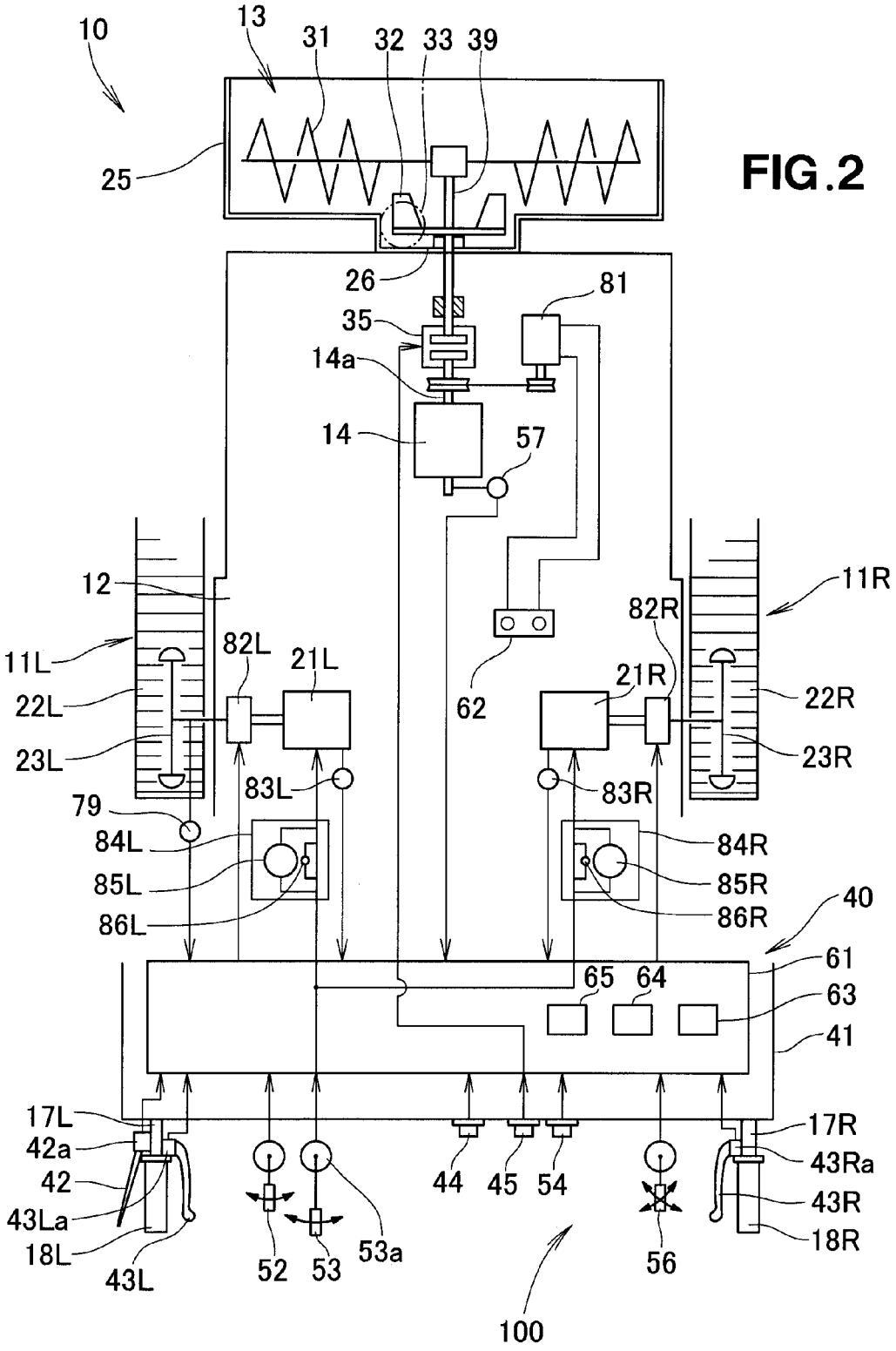
FIG. 2 is a schematic plan view of the snow removal machine of FIG. 1, which particularly shows a control system of the snow removal machine.

A first embodiment of the snow removal machine 10 of the present invention, as shown in FIGS. 1 and 2, is a self-propelled, auger type snow removal machine (also called a rotary snow removal machine) 10 which includes: left and right travel units 11L and 11R; a travel unit frame 12 having left and right travel units 11L and 11R mounted thereon; a snow removal work section 13 and an engine 14 mounted to the travel unit frame 12; and an engine 14.

More specifically, the travel unit frame 12 constitutes a machine body of the entire snow removal machine 10. The engine 14 is a drive source for driving the snow removal work section 13. Left and right operating handles 17L and 17R are mounted to rear portions of the travel unit frame 12 and extend obliquely rearwardly and upwardly from the travel unit frame 12. Left and right grips 18L and 18R are mounted to the distal ends of the left and right operating handles 17L and 17R, respectively.

The travel unit frame 12 also has mounted thereon left and right electric motors 21L and 21R for driving the left and right travel units 11L and 11R, respectively. The left and right travel units 11L and 11R are each a crawler type travel unit which comprises: a left or right crawler belt 22L or 22R; a left or right driving wheel 23L or 23R provided on a rear portion of the snow removal machine 10; and a left or right driven wheel 24L or 24R provided on a front portion of the snow removal machine 10.

The left crawler belt 22L can be driven by the left electric motor 21L via the left driving wheel 23L, while the right crawler belt 22R can be driven by the right electric motor 21R via the right driving wheel 23R.

Further, the snow removal work section 13 includes: an auger housing 25; a blower case 26 formed integrally with the back surface of the auger housing 25; an auger 31 housed in the auger housing 25; a blower 32 housed in the blower case 26; and a snow throwing section 33. The auger housing 25 includes a scraper 27 provided at its rear lower end.

The engine 14 is a snow removing drive source for driving the snow removal work section 13 via a snow removing power transmission mechanism 34. The snow removing power transmission mechanism 34 includes: a driving pulley 36 mounted on a crankshaft (output shaft) 14*a* of the engine 14 via an electromagnetic clutch 35; a driven pulley 38 operatively connected to the driving pulley 36 via a transmission belt 37.

Power of the engine 14 is transmitted to the auger 31 and the blower 32 via the output shaft 14*a*, electromagnetic clutch 35, driving pulley 36, transmission belt 37, driven pulley 38 and rotation shaft 39. Thus, snow gathered by the auger 31 can be blown far away by the blower 32 via the snow throwing section 33.

The human operator can manipulate or operate the snow removal machine 10 via the left and right operating handles 17L and 17R while walking behind the snow removal machine 10. An operation section 40, a control section 61 and a battery 62 are disposed between the left and right operating handles 17L and 17R.

Figure 3:
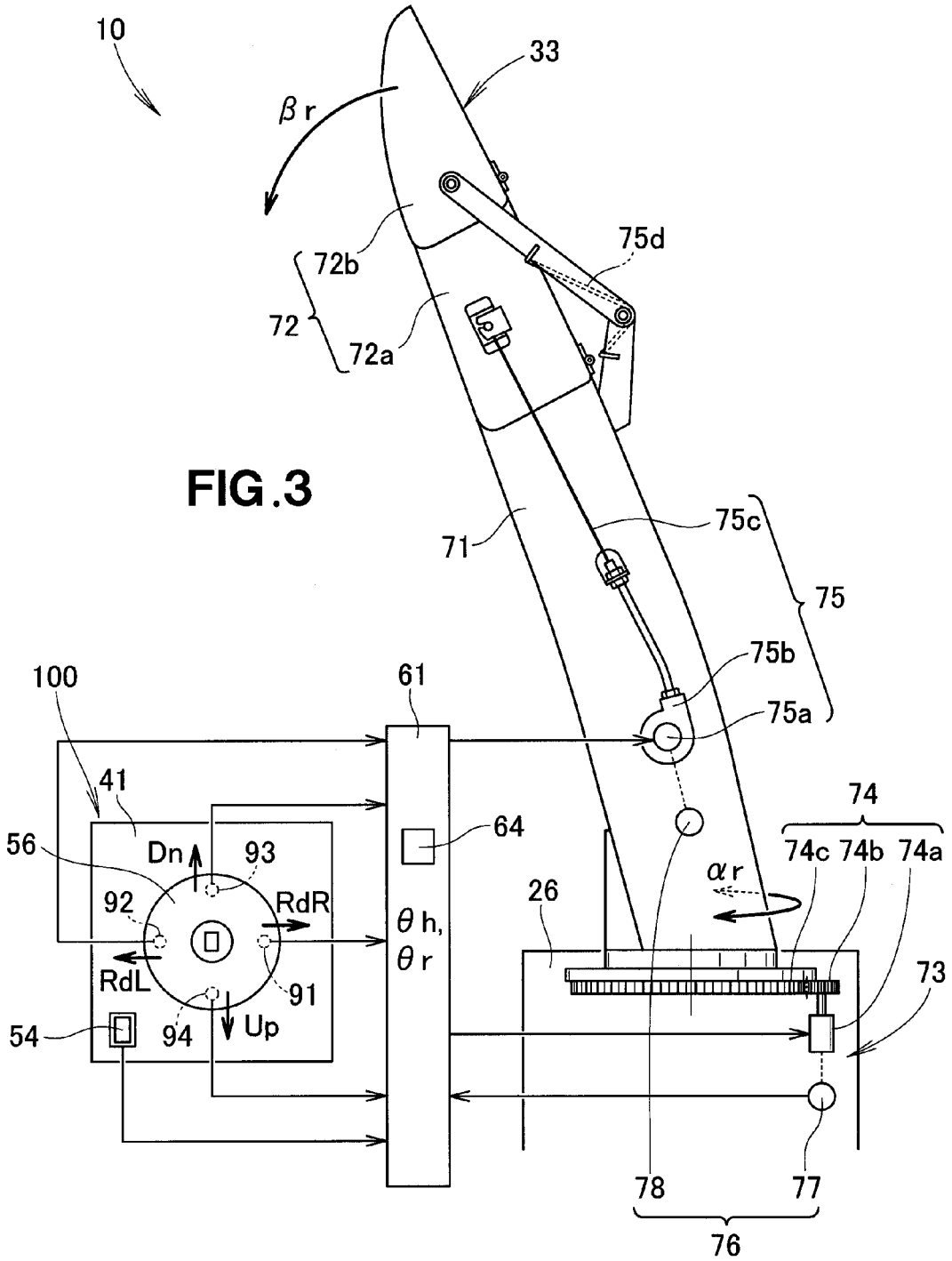
FIG. 3 is a schematic view showing relationship between a snow throwing section and an operation section shown in FIG. 1.

Further, as shown in FIGS. 1 and 3, the snow throwing section 33 is constructed to blow or throw snow, gathered by the auger 31, to a position considerably away from the snow removal machine 10. The snow throwing section 33 includes a chute 71 pivotable for adjusting a snow throwing direction, and a chute guide 72 pivotable in a vertical or up-down direction for adjusting a snow throwing angle in the vertical or up-down direction.

The chute 71 is a member extending upward from an upper portion of the blower case 26. The chute 71 is connected at its proximal end portion to the blower case 26 in such a manner that it is rotatable in a substantially horizontal direction. Thus, the chute 71 is rotatable in a substantially horizontal direction relative to the ground surface Gr the travel units 11L and 11R are contacting.

The chute guide 72 is vertically pivotably mounted to the upper end of the chute 71. Thus, the chute guide 72 is a so-called two-stage guide structure bendable in two stages in the up-down direction and comprises a lower guide member 72*a* and an upper guide member 72*b*. The lower guide member 72*a* is vertically pivotably connected at its lower end to the upper end of the chute 71, and the upper guide member 72*b* is vertically pivotably connected at its lower end to the upper end of the lower guide member 72*a*. Note that the chute guide 72 need not necessarily be such a two-stage guide structure and may comprise only one guide member.

As shown in FIG. 3, the snow throwing direction of the snow throwing section 33 is adjustable by a snow-throwing drive section 73. The snow-throwing drive section 73 includes a chute drive section 74 for pivotally driving the chute 71, and a guide drive section 75 for pivotally driving the chute guide 72.

The chute drive section 74 includes; a chute driving motor 74*a*; a pinion 74*b* mounted on a rotation shaft of the chute driving motor 74*a*; and a gear 74*c* meshing with the pinion 74*b*. The gear 74*c* is mounted on a proximal end portion of the chute 71. As the chute driving motor 74*a* is rotated in forward and reverse directions, the chute 71 and the chute guide 72 are turned in forward and reverse directions, i.e. clockwise and counterclockwise directions, as viewed from above the snow removal machine 10.

The guide drive section 75 includes; a guide driving motor 75*a*; a wire winding reel 75*b* connected to an output shaft of the guide driving motor 75*a*; and a wire cable 75*c* wound on the reel 75*b*. The wire cable 75*c* has one end portion connected to the chute guide 72. The chute guide 72 is normally biased or urged by a return spring 75*d* in such a direction where the chute guide 72 extends straight upward with respect to the upper end of the chute 71.

By the forward rotation of the guide driving motor 75*a*, the reel 75*b* rolls up or rewinds the wire cable 75*c*, so that the wire cable 75*c* pulls downward the chute guide 72. Thus, the chute guide 72 pivots downward against the biasing force of the return spring 75*d*. After that, the guide driving motor 75*a* rotates in the reverse direction, so that the reel 75*b* unwinds the wire cable 75*c*. Thus, the wire cable 75*c* loosens, so that the chute guide 72 pivots upward by the biasing force of the return spring 75*d*. A pivoting angle, i.e. an inclination angle in the up-down direction, of the chute guide 72 depends on a rotation amount of the guide driving motor 75*a*.

A snow throwing direction of the snow throwing section 33 is detected by a snow throwing direction sensor 76. The snow throwing direction sensor 76 comprises a chute angle sensor 77 for detecting a pivoting angle of the chute 71, and a guide angle sensor 78 for detecting an inclination angle (snow throwing angle), in the up-down direction, of the chute guide 72. The chute angle sensor 77 is built in or provided in the chute driving motor 74*a* for detecting a pivoting angle of the chute 71 by counting pulses generated in response to the rotation of the chute driving motor 74*a*. The guide angle sensor 78 is built in or provided in the guide driving motor 75*a* for detecting an inclination angle, in the up-down direction, of the chute guide 72 by counting pulses generated in response to the rotation of the guide driving motor 75*a*.

Alternatively, the chute angle sensor 77 may be constructed to directly detect a pivoting angle of the chute 71 and the guide angle sensor 78 may be constructed to directly detect an inclination angle, in the up-down direction, of the chute guide 72. In the case where it is desired the chute angle sensor 77 and the guide angle sensor 78 directly detect a pivoting angle of the chute 71 and an inclination angle of the chute guide 72 like this, each of the sensors 77 and 78 be in the form of a potentiometer.

Figure 4:
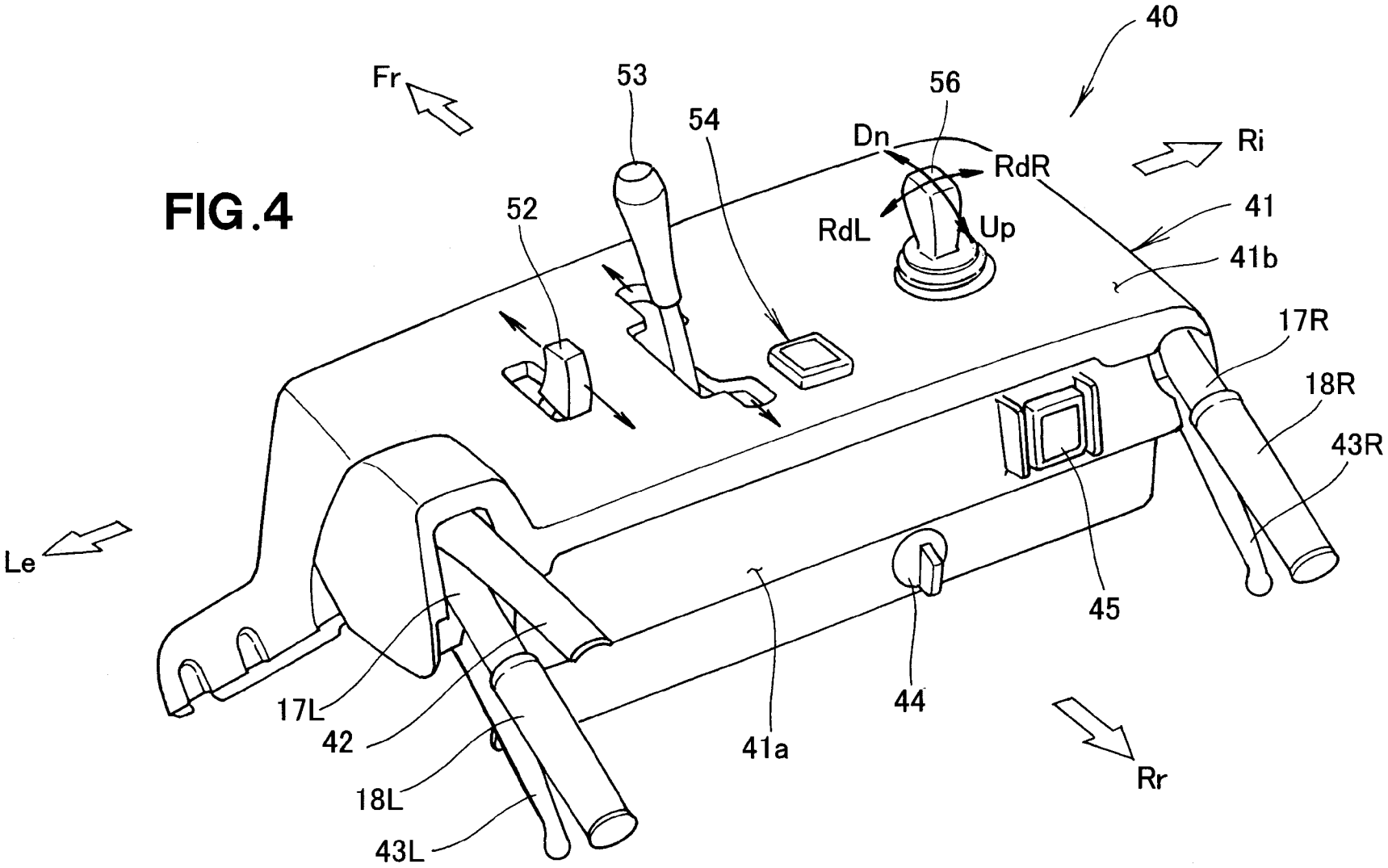
FIG. 4 is a rear upper perspective view of the operation section shown in FIG. 1.

Further, as shown in FIG. 4, the operation section 40 includes: an operation box 41 provided between the left and right operating handles 17L and 17R; a travel preparation lever 42 and a left turning operation lever 43L located near the left grip 18L and mounted to the left operating handle 17L; and a right turning operation lever 43R located near the right grip 18R and mounted to the right operating handle 17R.

The travel preparation lever 42 is a member that acts on a travel preparation switch 42*a* (see FIG. 2). The travel preparation switch 42*a* is turned off as it is placed in a free or released state as shown in FIG. 4 by pulling action of a return spring. The travel preparation switch 42*a* is turned on as the human operator grips and pivots the travel preparation lever 42 downward with his or her left hand.

The left and right turning levers 43L and 43R are turning operating members which are operable with the same human operator's hands gripping the left and right grips 18L and 18R and which act on corresponding turning switches 43La and 43Ra (see FIG. 2).

As these left and right turning levers 43L and 43R are placed in a free or released state by pulling action of corresponding return springs, the corresponding turning switches 43La and 43Ra are turned off. The left turning switch 43La is turned on as the human operator grips and pivots the left turning lever 43L upward toward the grip 18L with the left hand. Similarly, the right turning switch 43Ra is turned on as the human operator grips and pivots the right turning lever 43R upward toward the grip 18R with the right hand. Thus, whether or not the left and right turning levers 43L and 43R are currently being gripped by the human operator can be detected by the ON/OFF states of the corresponding turning switches 43La and 43Ra.

As shown in FIG. 4 and FIG. 2 as well, the operation box 41 includes a main switch 44 and an auger switch 45 (also referred to as "clutch operation switch 45") provided on its back surface 41*a*. The engine 14 can be activated by the human operator turning the main switch 45 to an ON position. The auger switch 45 is a manual switch, e.g. in the form of a push button switch, operable to switch the electromagnetic clutch 35 between ON (engaged) and OFF (disengaged) states.

The operation box 41 further includes, on its upper surface 41*b*, a throttle lever 52, a direction/speed lever 53, an assist switch 54 and a chute operation lever 56.

The throttle lever 52 is an operation member operable to control a rotation speed of the engine 14, and the rotation speed of the engine 14 is detected by an engine speed sensor 57. The direction/speed lever 53 is an operation member operable to control rotation of the electric motors 21L and 21R, details of which will be described later.

Further, the assist switch 54, which is for example in the form of a push button switch, is a manual switch operable to automatically control (i.e., perform auxiliary control on) angles of the chute 71 and the chute guide 72 shown in FIG. 1. For example, the assist switch 54 is a self-holding type switch that is turned on from an OFF state by the push button being depressed once with a hand of the human operator and turned off again by the push button being depressed again.

Further, the chute operation lever 56 is an operation member operable to change operating directions of the chute 71 and the chute guide 72 of FIG. 1, details of which will be described later.

The direction/speed lever 53 is reciprocatively operable, with a human operator's hand, forward and rearward from a neutral position as indicated by arrows. If the direction/speed lever 53 is shifted to a forward travel position, the snow removal machine 10 can be caused to travel forward as depicted by arrow Fr in FIG. 1. Further, speed control can be performed such that the snow removal machine 10 can be caused to travel forward at a higher speed as the direction/speed lever 53 is shifted further forward from the neutral position. Likewise, if the direction/speed lever 53 is shifted to a rearward travel position, the snow removal machine 10 can be caused to travel rearward as depicted by arrow Rr in FIG. 1. Further, speed control can be performed such that the snow removal machine 10 can be caused to travel rearward at a higher speed as the direction/speed lever 53 is shifted further rearward from the neutral position.

In the illustrated example, voltage corresponding to a current position of the direction/speed lever 53 is produced by a potentiometer 53*a* (see FIG. 2). Because the direction/speed lever 53 is operable to set both a forward or rearward direction and a high or low speed of the snow removal machine 10, it will be referred to also as "forward/rearward travel speed adjustment lever 53".

The following describe, with reference to FIG. 2, a control system of the snow removal machine 10 which centers on the control section 61. The control section 61 contains a memory 63 and performs control by reading out various information stored in the memory 63.

The control section 61 also contains a frame inclination angle detection section 64 and a turning angle sensor 65. The frame inclination angle detection section 64 and the turning angle sensor 65 are integrated on a substrate together with other electronic circuits of the control section 61 (as a MEMS (MicroElectroMechanical System)). The frame inclination angle detection section 64 detects an inclination angle of the travel unit frame 12 itself relative to the ground surface Gr (see FIG. 1) which the travel units 11L and 11R are contacting. The turning angle sensor 65 detects a turning angle of the travel unit frame 12 itself.

The left and right operating handles 17L and 17R extend obliquely rearward and upward from rear portions of the travel unit frame 12 having the left and right travel units 11L and 11R mounted thereon, and the control section 61 is mounted on the left and right operating handles 17L and 17R and has the frame inclination angle detection section 64 and the turning angle sensor 65 provided therein. Such provision of the frame inclination angle detection section 64 and the turning angle sensor 65 is substantively equivalent to a construction where these detection section 64 and sensor 65 are provided directly on the travel unit frame 12. Thus, the frame inclination angle detection section 64 can detect an inclination angle of the travel unit frame 12 itself, and the turning angle sensor 65 can detect a turning angle of the travel unit frame 12 itself. Note that the frame inclination angle detection section 64 and the turning angle sensor 65 may be provided directly on the travel unit frame 12.

The frame inclination angle detection section 64 comprises, for example, an acceleration sensor. More specifically, the acceleration sensor is a three-axis acceleration sensor capable of detecting acceleration in three axis directions, i.e. X-axis, Y-axis and Z-axis directions. The three-axis acceleration sensor may be a conventional sensor, such as a so-called semiconductor acceleration sensor. The semiconductor acceleration sensor employed here may be of a piezo resistance type, capacitance type or thermally sensitive type.

Such a three-axis acceleration sensor is capable of detecting acceleration in three axis directions produced in the travel unit frame 12 itself. Acceleration in the X-axis direction is acceleration in the vertical direction or direction of gravitational force (gravity acceleration) produced in the travel unit frame 12 itself. Acceleration in the Y-axis direction is acceleration in a horizontal left-right direction produced in the travel unit frame 12 itself. Further, acceleration in the Z-axis direction is acceleration in a horizontal front-rear direction produced in the travel unit frame 12 itself.

Because such acceleration produced in the travel unit frame 12 itself is detected by the acceleration sensor and an inclination of the travel unit frame 12 itself is evaluated on the basis of values of the detected acceleration, the frame inclination angle detection section 64 in the instant embodiment comprises the acceleration sensor.

Further, because the frame inclination angle detection section 64 detects an inclination angle of the entire snow removal machine 10 relative to the horizontal surface, it will be referred to also as "snow removal machine inclination angle sensor 64". The horizontal plane is, for example, a preset horizontal flat surface (reference surface). Zero-point correction of the frame inclination angle detection section 64 is performed, prior to shipment from a factory of the snow removal machine 10, with the snow removal machine 10 placed on the preset horizontal flat surface.

Further, the turning angle sensor 65 comprises, for example, a gyro sensor or a yaw rate sensor. A turning angle of the travel unit frame 12 itself can be detected directly by the gyro sensor. A vibration type gyro using piezoelectric ceramic can be employed as the gyro sensor. Alternatively, a yaw angle, i.e. a turning angle, of the travel unit frame 12 itself can be evaluated by integrating a yaw rate detected by the yaw rate sensor. Because the turning angle sensor 65 is designed to detect a turning angle of the entire snow removal machine 10, it will be referred to also as "snow removal machine turning angle sensor 65".

A power generator 81 is rotated by a portion of output of the engine 14, and electric power generated by the power generator 81 is supplied to the left and right electric motors 21L and 21R and other electric components. The remaining portion of the output of the engine 14 is used to drive or rotate the auger 31 and the blower 32.

By the human operator gripping the travel preparation lever 42 and operating the auger switch 45, the electromagnetic clutch 35 is turned on, so that the auger 31 and the blower 32 can be rotated by the output power of the engine 14. Then, the electromagnetic clutch 35 can be turned off by the human operator releasing (i.e., letting go of) the travel preparation lever 42.

The following describe behavior of the travel units 11L and 11R. The snow removal machine 10 of the present invention includes left and right electromagnetic brakes 82L and 82R as brakes that correspond to a parking brake of an ordinary vehicle. More specifically, respective shafts of the left and right electric motors 21L and 21R are braked by means of the left and right electromagnetic brakes 82L and 82R. During parking of the snow removal machine 10, the left and right electromagnetic brakes 82L and 82R are kept in a braking (i.e., ON) state under the control of the control section 61. Then, the left and right electromagnetic brakes 82L and 82R are released or turned off in the following manner.

Upon satisfaction of two conditions that the main switch 44 is in an ON position and that the travel preparation lever 42 is being gripped, the left and right electromagnetic brakes 82L and 82R are turned off in response to the direction/speed lever 53 being switched to the forward travel position or to the rearward travel position.

Then, upon receipt, from the potentiometer 53*a*, position information of the direction/speed lever 53, the control section 61 rotates the left and right electric motors 21L and 21R via left and right motor drivers 84L and 84R, detects rotating speed of the motors 21L and 21R by means of rotation sensors 83L and 83R, and performs feedback control, on the basis of detection signals of the rotation sensors 83L and 83R, such that the rotating speed of the motors 21L and 21R assumes a predetermined value. As a consequence, the left and right driving wheels 23L and 23R rotate in a desired direction at predetermined speed, so that the snow removal machine 10 is brought to a traveling state.

A traveled distance of the snow removal machine 10 is detected via a traveled distance sensor 79. The traveled distance sensor 79 may comprise a sensor for directly detecting a traveled distance of the snow removal machine 10 or may be constructed to detect a traveled distance of the snow removal machine 10 on the basis of an integrated value of traveling speed of the left and right travel units 79. Alternatively, the traveled distance sensor 79 may be constructed to detect a traveled distance of the snow removal machine 10 on the basis of an integrated value of the rotating speed of the electric motors 21L and 21R detected via the motor rotation sensors 83L and 83R.

Braking of the snow removal machine 10 during travel is performed in the following manner. The motor drivers 84L and 84R include, as braking means, regenerative braking circuits 85L and 85R and short circuit braking circuits 86L and 86R.

While the human operator is keeping the left turning switch 43La ON while gripping the left turning operation lever 43L, the control section 61 activates the left regenerative braking circuit 85L to lower the rotating speed of the left electric motor 21L. Similarly, while the human operator is keeping the right turning switch 43Ra ON while gripping the right turning operation lever 43R, the control section 61 activates the right regenerative braking circuit 85R to lower the rotating speed of the right electric motor 21R. Namely, only while the left turning operation lever 43L is being gripped, the snow removal machine 10 can be turned left. Similarly, only while the right turning operation lever 43R is being gripped, the snow removal machine 10 can be turned right. Then, the traveling motion of the snow removal machine 10 can be stopped by the human operator (1) releasing (letting go of) the travel preparation lever 42, (2) returning the main switch 44 to the OFF position or (3) returning the direction/speed lever 53 to the neutral position.

Further, as shown in FIG. 3, the control section 61 controls the snow-throwing drive section 73 to adjust snow throwing directions α r and β r of the snow throwing section 33 on the basis of detection values of the snow throwing directions α r and β r detected by the snow throwing direction sensor 76 and inclination angles θ h and θ r detected by the frame inclination angle detection section 64.

More specifically, the control section 61 is configured to (1) control the chute drive section 74 to adjust the pivoting angle α r of the chute 71 on the basis of detection values of a pivoting angle α r of the chute 71 detected by the chute angle sensor 77 and the inclination angles θ h and θ r detected by the frame inclination angle detection section 64, and (2) control the guide drive section 75 to adjust an inclination angle β r in the vertical or up-down (pivoting) direction of the chute guide 72 on the basis of detection values of the inclination angle β r, in the up-down direction, of the chute guide 72 detected by the guide angle sensor 78 and the inclination angles θ h and θ r detected by the frame inclination angle detection section 64.

The following describe in detail, with reference to FIG. 3, relationship among the chute 71, the chute guide 72 and the chute operation lever 56. A chute direction operation section 100 comprises the chute operation lever 56 and four chute-direction operating switches 91 to 94.

Once the human operator pivots the chute operation lever 56 to a rightward position RdR, the right rotating switch 91 is turned on to output an ON signal, upon receipt of which the control signal 61 rotates the chute driving motor 74*a* (chute drive section 74) in the forward direction. Thus, the chute driving motor 74*a* drives the chute 71 in the forward direction (clockwise direction as viewed in top plan).

Once the human operator pivots the chute operation lever 56 to a leftward position RdL, on the other hand, the left rotating switch 92 is turned on to output an ON signal, upon receipt of which the control signal 61 rotates the chute driving motor 74*a* in the reverse direction. Thus, the chute driving motor 74*a* drives the chute 71 in the reverse direction (counterclockwise direction as viewed in top plan).

Further, once the human operator pivots the chute operation lever 56 to a forward position Dn, the lowering switch 93 is turned on to output an ON signal, upon receipt of which the control signal 61 rotates the guide driving motor 75*a* (guide drive section 75) in the forward direction. Thus, the guide driving motor 75*a* pivots the chute guide 72 downward.

Once the human operator pivots the chute operation lever 56 to an upward position Up, the raising switch 94 is turned on to output an ON signal, upon receipt of which the control signal 61 rotates the guide driving motor 75*a* in the reverse direction. Thus, the guide driving motor 75*a* pivots the chute guide 72 upward.

Namely, in response to the human operator pivoting the chute operation lever 56 to the leftward position or to the rightward position, the chute driving motor 74*a* rotates in the forward or leftward direction to pivot the chute 71. The chute angle sensor 77 detects a pivoting angle α r of the chute 71 and outputs a detection signal of the pivoting angle α r of the chute 71 to the control section 61.

Further, in response to the human operator pivoting the chute operation lever 56 to the forward or rearward position, the guide driving motor 75*a* rotates in the forward or leftward direction to pivot the chute guide 72 in the up-down direction. The guide angle sensor 78 detects an inclination angle β r, in the up-down direction, of the chute 71 and outputs a detection signal of the pivoting angle α r of the chute guide 72 to the control section 61.

Figure 5:
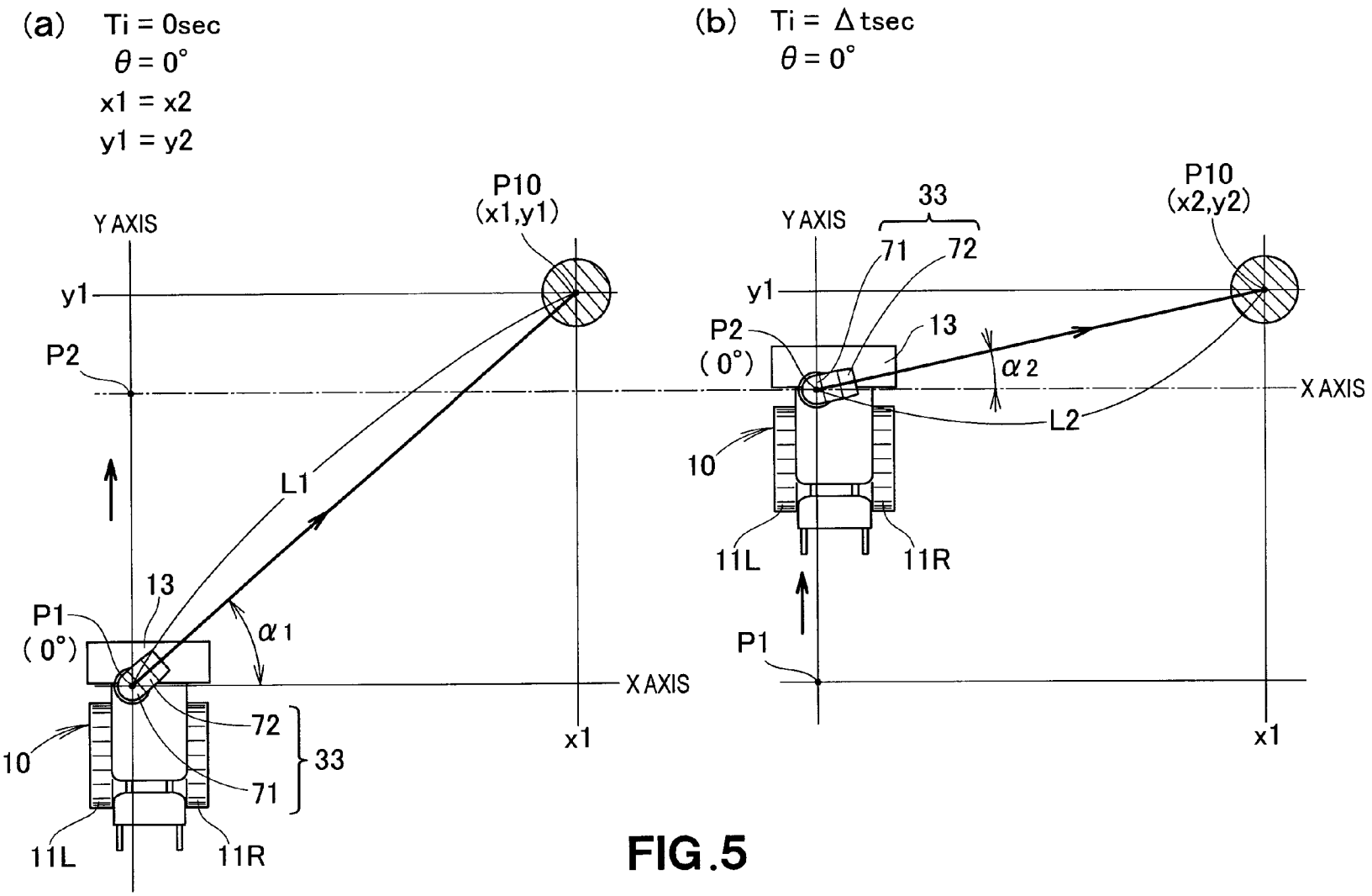
FIG. 5 is a schematic view showing relationship between variation in traveled distance of the snow removal machine and variation in snow throwing direction of the snow throwing section shown in FIG. 1.

The following describe, with reference to FIG. 5, relationship between variation in the traveled distance of the snow removal machine 10 and variation in the snow throwing direction of the snow throwing section 33.

FIG. 5(*a*) shows coordinates of the snow removal machine 10 as viewed from above at a time point when a snow throwing direction of the snow throwing section 33 has been set (elapsed time Ti=0 sec). In the coordinate system of FIG. 5(*a*), the original point is "0" and the horizontal axis is an X axis while the vertical axis is a Y axis. At the time point illustrated in the figure, the pivot center P1 of the chute 72 is located at the original point 0 of the coordinate system. It is assumed here that the snow removal section 10 removes snow by means of the snow removal section 13 while traveling forward on a flat ground surface Gr (see FIG. 1) along the Y axis. Namely, the turning angle θ of the snow removal machine 10 is 0° in the illustrated example The human operator can set a desired target snow throwing position P10 by operating the chute 71 and the chute guide 72. The target snow throwing position P10 (instructed snow throwing position P10) is set, for example, at a position rightward and forward of the snow removal machine 10. Coordinates of the target snow throwing position P10 are x1, y1. Here, a time point when the assist switch 54 of FIG. 3 has been turned on is an initial point when a snow throwing direction of the snow throwing section 33 has been set. A distance Lr from the pivot center P1 of the chute of the chute 71 to the target snow throwing position P10, i.e. an initial snow throwing distance Lr of the snow throwing section 33, is L1 (Lr=L1). Further, an initial snow throwing angle α r of the chute 71 from the X axis is α 1 (α r=α 1).

Further, as shown in FIG. 5(*b*), once the snow removal machine 10 travels forward until the elapsed time Ti reaches Δ t sec (Ti=Δ t), the pivot center P1 of the chute 71 moves to a point P2. Namely, in this case, the snow removal machine 10 has moved over a distance from the point P1 to the moved-to point P2 located on the Y axis; however, the target snow throwing position P10 has not varied. If the new pivot center P2 is set as a new original point of the coordinate system, snow throwing coordinates of the target snow throwing position P10 are x2, y2. A distance Lr from the moved-to point P2 (i.e., new pivot center P2 of the chute of the chute 71) to the target snow throwing position P10, i.e. a snow throwing distance Lr of the snow throwing section 33, is L2 (Lr=L2). Further, a new snow throwing angle α r of the chute 71 from the X axis is α 2 (α r=α 2).

Namely, the snow removal machine 10 removes snow by means of the snow removal section 13 while traveling forward along the Y axis. The control section 61 (see FIG. 3) automatically adjusts the snow throwing direction of the snow throwing section 33 in such a manner as to maintain the target snow throwing position P10.

Figure 6:
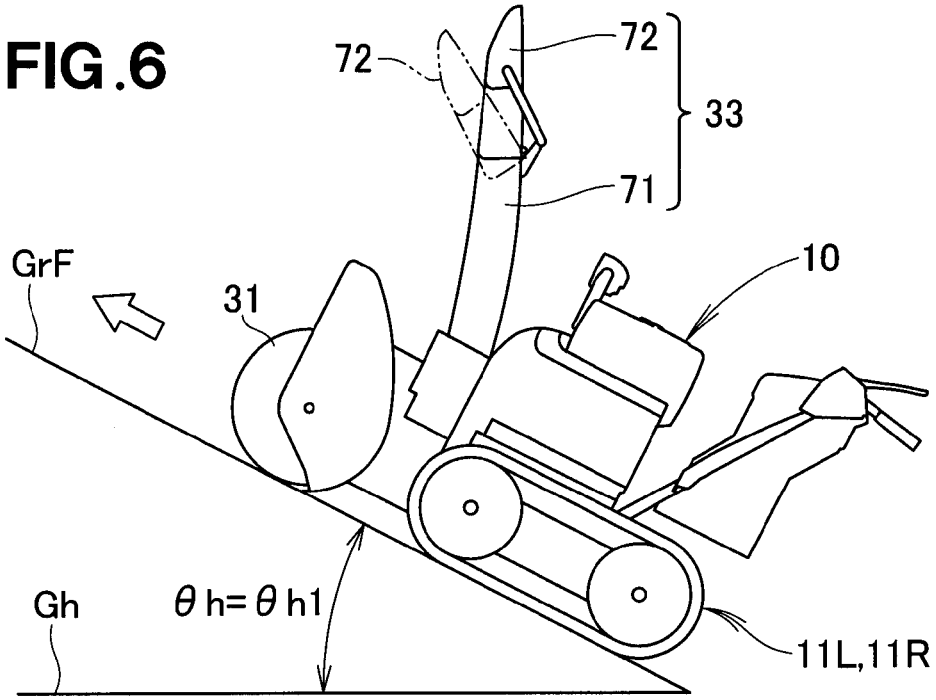
FIG. 6 is a side view of the snow removal machine of FIG. 1 traveling forward on an upward slope.
Figure 7:
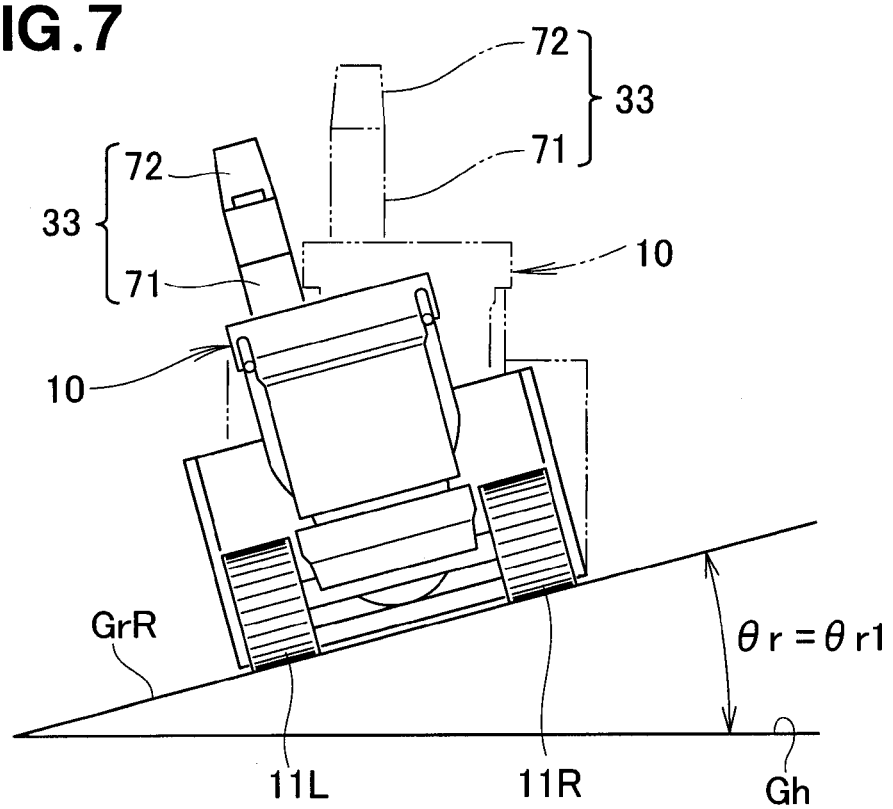
FIG. 7 is a rear view of the snow removal machine of FIG. 1 traveling forward on a rightward upward slope.

The following describe, with reference to FIGS. 6 and 7, relationship between the snow removal machine 10 traveling on a sloping ground surface and the snow throwing section 33. FIG. 6 shows a case where the snow removal machine 10 is traveling on an upwardly sloping ground surface GrF. In this case, a value of an inclination angle θ h of the upwardly sloping ground surface GrF to the horizontal surface Gh is θ h1 (θ h=θ h1). Because the travel units 11L and 11R are contacting the upwardly sloping ground surface GrF, an angle of inclination in the front-rear direction of the snow removal machine 10 is also θ h1.

If the snow removal machine 10 has inclined forwardly and upwardly when snow is being thrown forward by the snow throwing section 33, then the snow cannot be accurately thrown to the target snow throwing position P10 with the inclination angle β r, in the up-down direction, of the chute guide 72 left unchanged. Thus, in the instant embodiment of the invention, inclination angles θ h and θ r, in the front-rear direction and in the left-right direction, of the snow removal machine 10 are detected, and the snow throwing angle α r of the chute 71 and the inclination angle β r, in the up-down direction, of the chute guide 72 are automatically adjusted in accordance with the detected inclination angles θ h and θ r of the snow removal machine 10, so that snow can be accurately thrown to the target snow throwing position P10.

FIG. 7 shows a case where the snow removal machine 10 is traveling on a rightwardly and upwardly sloping ground surface GrR. In this case, a value of an inclination angle θ r of the rightwardly and upwardly sloping ground surface GrR is θ r1 (θ r=θ r1). Because the travel units 11L and 11R are contacting the rightwardly and upwardly sloping ground surface GrR, an inclination angle θ r, in the left-right direction, of the snow removal machine 10 is also θ r1.

If the snow removal machine 10 has inclined rightwardly and upwardly when snow is being thrown sideways by the snow throwing section 33, then the snow cannot be accurately thrown to the target snow throwing position P10 with the snow throwing angle α r of the chute 71 and the inclination angle β r, in the up-down direction, of the chute guide 72 left unchanged. Thus, in the instant embodiment of the invention, inclination angles θ h and θ r, in the front-rear direction and left-right direction, of the snow removal machine 10 are detected and the snow throwing angle α r of the chute 71 and the inclination angle β r, in the up-down direction, of the chute guide 72 are automatically adjusted in accordance with the detected inclination angled θ h and θ r of the snow removal machine 10, so that snow can be accurately thrown to the target snow throwing position P10.

The control section 61 in the instant embodiment may be implemented by a microcomputer, and the following describe, with reference to FIGS. 8 to 12, flows of control performed by the control section 61 implemented by a microcomputer. For example, such flows of control are started upon turning-on of the main switch 44 and ended upon turning-off of the main switch 44. Of various control of the snow removal machine 10, only steps related to the control of the snow throwing direction of the snow throwing section 33 will be described hereinbelow, with reference to control flow charts of FIGS. 8 to 12 with steps related to the other control omitted for clarity.

Figure 8:
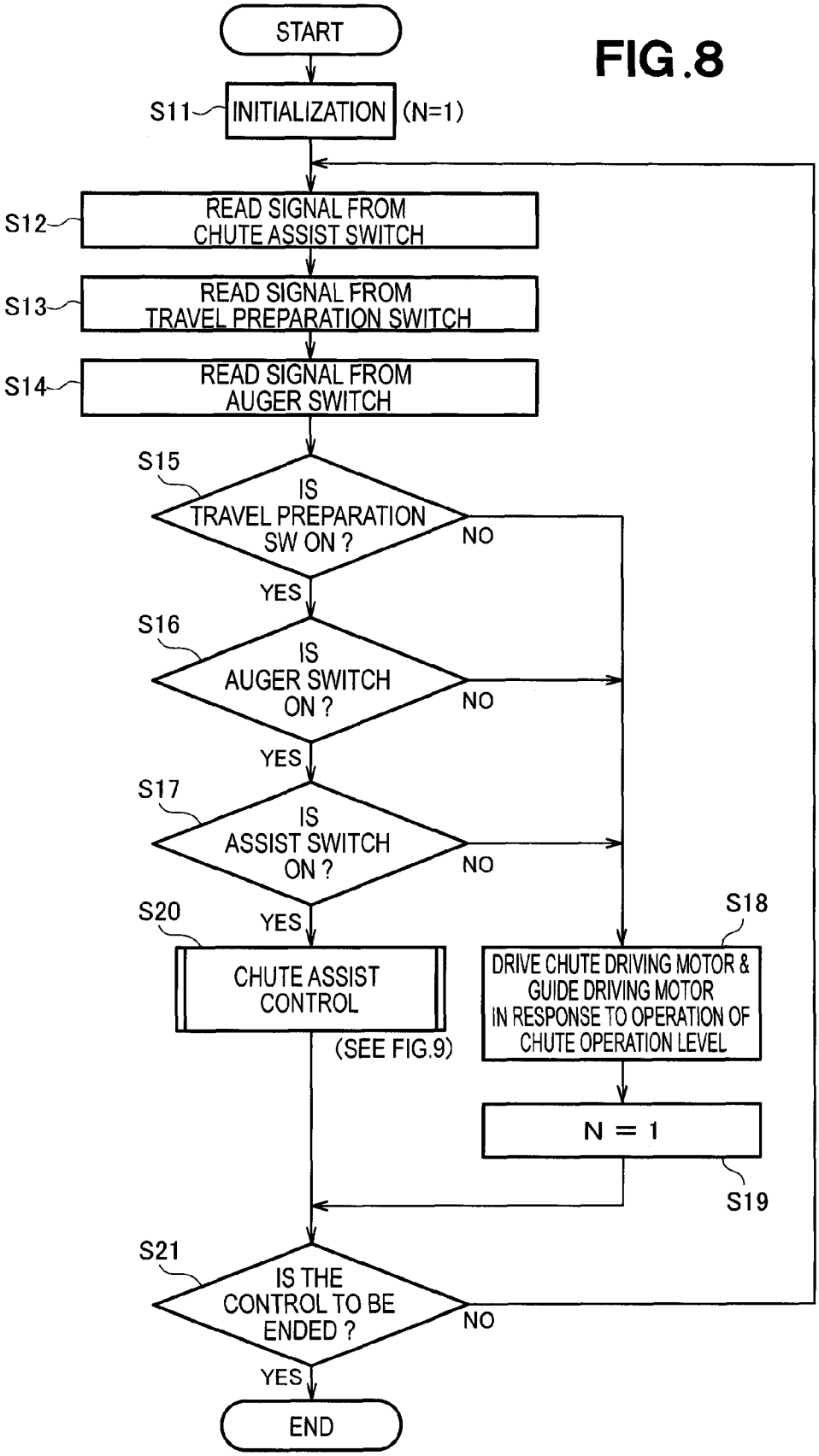
FIG. 8 is a control flow chart explanatory of control performed by a control section shown in FIG. 2.

FIG. 8 is a flow chart showing a main routine performed by the control section 61 in the instant embodiment. Upon start of the main routine, the control section 61 first performs at step S11 an initialization process for initializing various settings and flags to predetermined initial values; for example, the control section 61 reset a count value of a counter N to "1".

Then, the control section 61 reads a signal output from the assist switch 54 at step S12, reads a signal output from the travel preparation switch 42*a* of the travel preparation lever 42 at step S13 and reads a signal output from the auger switch 45 at step S14.

Then, at step S15, the control section 61 determines whether the travel preparation switch 42*a* is in the ON state. If the travel preparation switch 42*a* is ON as determined at step S15 (i.e., YES determination at S15), the control section 61 further determines at step S16 whether the auger switch 45 is ON. If the auger switch 45 is ON (YES determination at S16), the control section 61 further determines at step S17 whether the assist switch 54 is ON. If the assist switch 54 is ON (YES determination at S17), the control section 61 proceeds to step S20.

Namely, when at least one of the travel preparation switch 42*a*, the auger switch 45 and the assist switch 54 is OFF, the control section 61 determines that an assist condition (i.e., automatic control condition) of the snow throwing section 33 is not satisfied, and thus, the control section 61 branches to step S18. At step S18, the control section 61 drives the chute driving motor 71 and the guide driving motor 75*a* as desired in response to the human operator operating the chute operation lever 56 to manually operate any one of the four chute direction operating switches 91 to 94. In this manner, the snow throwing angle α r of the chute 71 and the inclination angle β r, in the up-down direction, of the chute guide 72 can be set at desired values. Following step S18, the control section 61 sets the count value of the counter N at "1" at step S19 and then proceeds to step S21.

When all of the travel preparation switch 42*a*, the auger switch 45 and the assist switch 54 are ON, the control section 61 goes to step S20 to perform chute assist control processing. A detailed control flow of the chute assist control processing will be described later with reference to FIG. 9. When the assist switch 54 has been turned on, the pivot center P1 of the chute 71 shown in FIG. 5(*a*) becomes the original point 0 of the coordinate system.

Following step S19 or step S20, the control section 61 determines at step S21 whether the control flow is to be ended. If the main switch 44 is ON, the control section 61 determines that the control is to be continued and then revers to step S12. If the main switch 44 is OFF, on the other hand, the control section 61 determines that the control is to be ended, so that the series of control is brought to an end.

Figure 9:
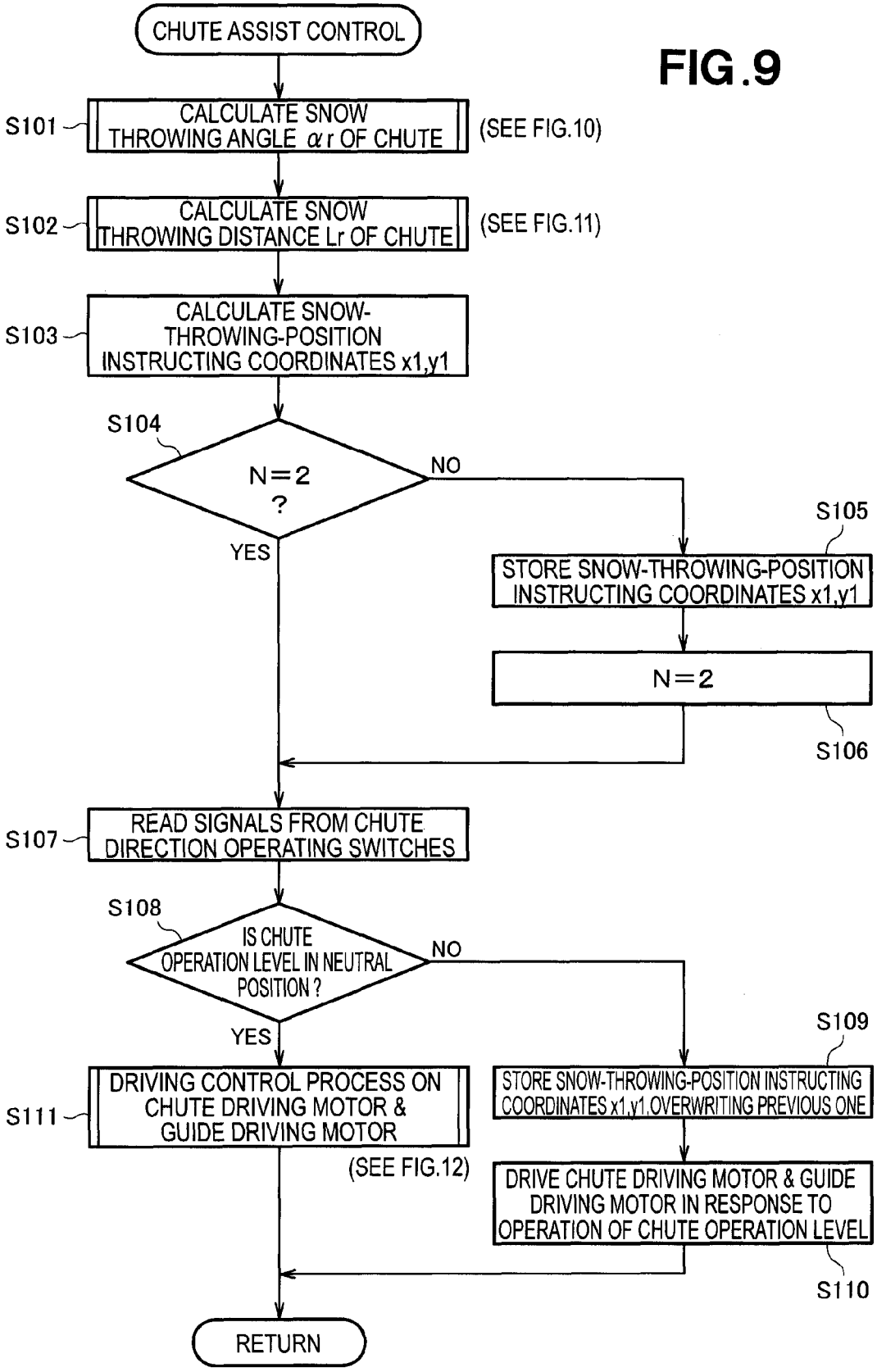
FIG. 9 is a detailed control flow chart of step S20 shown in FIG. 8.

The following describe the detailed control flow of the chute assist control processing. FIG. 9 is a flow chart showing a subroutine for the control section 61 to perform the chute assist control at step S20 shown in FIG. 8.

First, at step S101 of FIG. 9, the control section 61 calculates a current snow throwing angle α r of the chute 71. A detailed control flow for performing a process to calculate a current snow throwing angle α r of the chute 71 at step S101 will be described later with reference to FIG. 10.

Then, at step S102, the control section 61 calculates a current snow throwing distance Lr of the chute 71. A detailed control flow for performing a process to calculate a current snow throwing distance Lr of the chute 71 at step S102 will be described later with reference to FIG. 11.

Next, at step S103, the control section 61 calculates current snow-throwing-position instructing coordinates x1,y1 on the basis of the snow throwing angle α r and snow throwing distance Lr of the chute 71. Then, the control section 61 determines at step S104 whether the current count of the counter N is "2". If the current count of the counter N is not "2", i.e. if the current count of the counter N is "1" (N=1), the control section 61 determines that the current process is the first execution of the process after the turning-on of the assist switch 54, and the control section 61 stores the current snow-throwing-position instructing coordinates x1,y1 into the memory 63 at step S105. Next, the control section 61 increments the count of the counter N to "2" at step S106 and then proceeds to step S107.

If, on the other hand, the current count of the counter N is "2" as determined at step S104 above, the control section 61 determines that the current process is the second or subsequent execution of the process after the turning-on of the assist switch 54, and it goes directly to step S107. At step S107, the control section 61 reads signals from the four chute direction operating switches 91 to 94.

Then, at step S108, the control section 61 determines whether the chute operation lever 56 is currently in a neutral position. If any one of the four chute direction operating switches 91 to 94 is currently ON, the control section 61 determines that the chute operation lever 56 is being operated instead of being in the neutral position, and thus, the control section 61 branches to step S109.

At step S109, the control section 61 stores the current snow-throwing-position instructing coordinates x1,y1 into the memory 63, overwriting the previous snow-throwing-position instructing coordinates if any. At next step S110, the control section 61 drives the chute driving motor 74*a* and the guide driving motor 75*a* as desired in response to the human operator operating the chute operation lever 56 to manually operate any one of the four chute direction operating switches 91 to 94, after which the control section 61 ends the chute assist control subroutine. In this manner, the snow throwing angle α r of the chute 71 and the inclination angle β r, in the up-down direction, of the chute guide 72 can be set at desired values.

If, on the other hand, the chute operation lever 56 is currently in the neutral position as determined at step S108, the control section 61 ends the chute assist control subroutine after performing a driving control process on the chute driving motor 74*a* and the guide driving motor 75*a* at S111.

Figure 10:
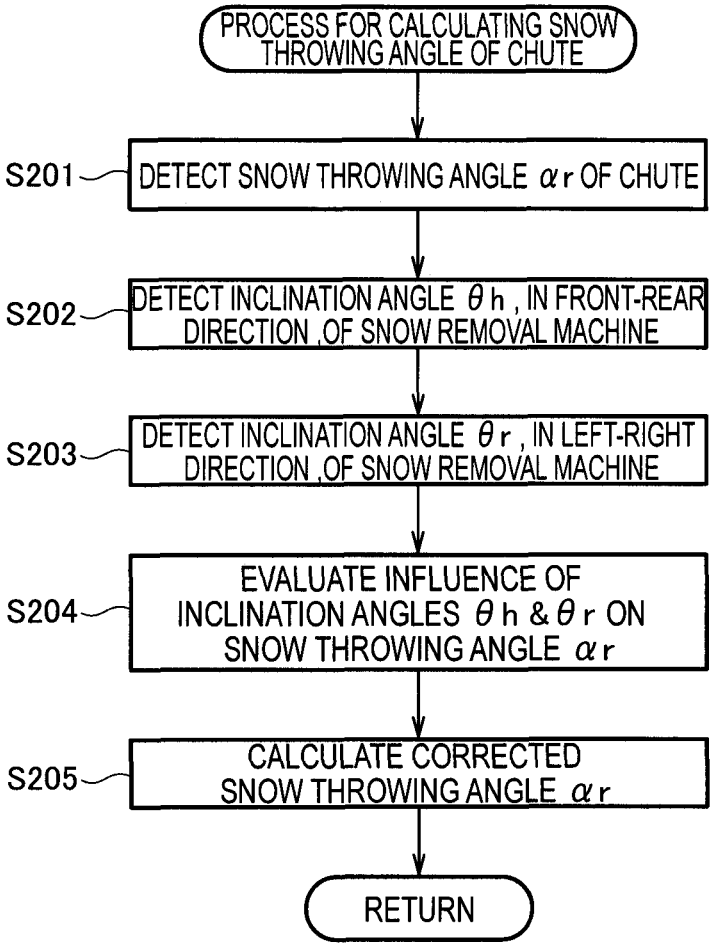
FIG. 10 is a detailed control flow chart of step S101 shown in FIG. 9.

The following describe a detailed control flow for performing the process for calculating a snow throwing angle α r of the chute 71. FIG. 10 is a flow chart showing a subroutine for the control section 61 to perform the process for calculating a snow throwing angle α r of the chute 71 at step S101 shown in FIG. 9.

First, at step S201 of FIG. 10, the control section 61 detects a snow throwing angle α r of the chute 71 by means of the chute angle sensor 77. At next step S202, the control section 61 detects an inclination angle θ h, in the front-rear direction, of the snow removal machine 10 by means of the snow removal machine inclination angle sensor 64. Then, at step S203, the control section 61 detects an inclination angle θ r, in the left-right direction, of the snow removal machine 10 by means of the snow removal machine inclination angle sensor 64.

Then, at step S204, the control section 61 evaluates influence of the inclination angles θ h and θ r on the snow throwing angle α r of the chute 71. The greater the inclination angles θ h and θ r, the more the snow throwing angle α r of the chute 71 is influenced. Thus, there arises a need for correcting the snow throwing angle α r of the chute 71 by an amount corresponding to the evaluated influence.

Next, at step S205, the control section 61 calculates a corrected snow throwing angle α r of the chute 71 by correcting the detected snow throwing angle α r, after which it ends the subroutine process for calculating a snow throwing angle α r of the chute 71.

Figure 11:
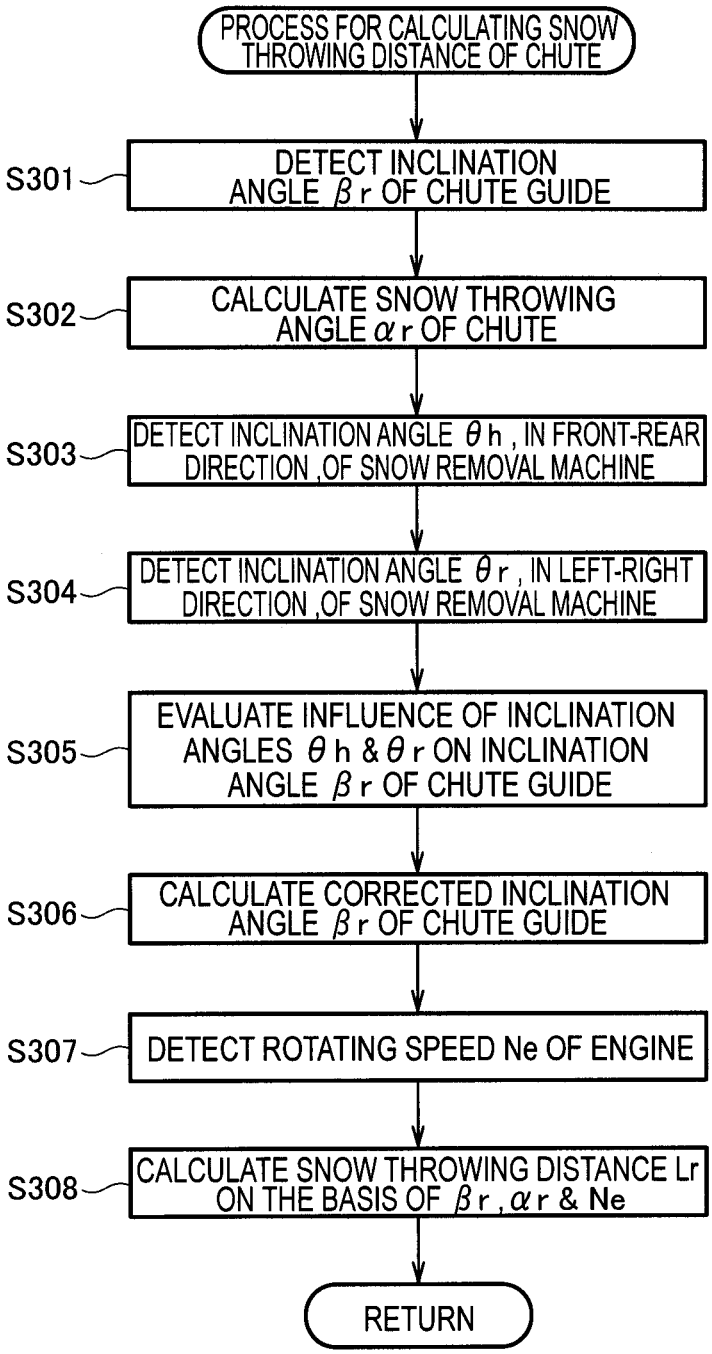
FIG. 11 is a detailed control flow chart of step S102 shown in FIG. 9.

Further, the following describe a detailed control flow for performing the process for calculating a snow throwing distance Lr of the chute 71. FIG. 11 is a flow chart showing a subroutine for the control section 61 to perform the process for calculating a snow throwing distance Lr of the chute 71 at step S102 shown in FIG. 9.

First, at step S301 of FIG. 11, the control section 61 detects an inclination angle β r, in the up-down direction, of the chute guide 72 by means of the guide angle sensor 78. At next step S302, the control section 61 detects a snow throwing angle α r of the chute 71 by means of the chute angle sensor 77.

Then, at step S303, the control section 61 detects an inclination angle β r, in the front-rear direction, of the snow removal machine 10 by means of the snow removal machine inclination angle sensor 64. At next step S304, the control section 61 detects an inclination angle θ r, in the left-right direction, of the snow removal machine 10 by means of the snow removal machine inclination angle sensor 64.

Then, at step S305, the control section 61 evaluates influence of the inclination angles θ h and θ r on the inclination angle β r, in the up-down direction, of the chute guide 72. The greater the inclination angles θ h and θ r, the more the inclination angle β r is influenced. Thus, there arises a need for correcting the inclination angle β r of the chute geode 72 by an amount corresponding to the evaluated influence.

Next, at step S306, the control section 61 calculates a corrected inclination angle β r of the chute guide 72 by correcting the detected inclination angle β r with the amount corresponding to the influence (correction value) evaluated at step S305 above. Then, at step S307, the control section 61 detects rotating speed Ne of the engine 14 by means of the engine speed sensor 57.

Then, at step S308, the control section 61 calculates a snow throwing distance Lr of the chute 71 on the basis of the inclination angle β r, in the up-down direction, of the chute guide 72, the snow throwing angle α r (snow throwing direction) of the chute 71 and the rotating speed Ne of the engine 14, after which the control section 61 ends the instant subroutine process for calculating a snow throwing distance Lr of the chute 71. Any one of the following two schemes may be employed for calculating a snow throwing distance Lr of the chute 71 on the basis of the inclination angle β r, in the up-down direction, of the chute guide 72.

The first scheme is one that uses a snow throwing distance map for minimal-speed rotation of the engine 14. Namely, the rotating speed Ne of the engine 14 in an idling state will be referred to as "minimal rotating speed". A map of relationship between values of the inclination angles β r, in the up-down direction, of the chute guide 72 and values of the snow throwing distance Lr of the chute 71 at such a minimal rotating speed is created and stored in the memory 63 in advance.

According to the first scheme, actual rotating speed Ne of the engine 14 is detected first. Then, a multiplication factor or ratio of the actual rotating speed Ne of the engine 14 to the minimal rotating speed is calculated. Then, an actual inclination angle β r, in the up-down direction, of the chute guide 72 is detected. Then, a value of the snow throwing distance Lr for the actual inclination angle β r is obtained from the above-mentioned snow throwing distance map for minimal-speed rotation of the engine. Last, a value of the snow throwing distance Lr for the actual rotating speed Ne is obtained by the value of the snow throwing distance Lr, obtained from the snow throwing distance map, being multiplied by the abovementioned ratio.

The second scheme is one that uses snow throwing distance maps for individual rotating speed of the engine 14. Namely, a map of relationship between values of the inclination angles β r, in the up-down direction, of the chute guide 72 and values of the snow throwing distance Lr of the chute 71 is created for each rotating speed of the engine 14 and stored in the memory 63 in advance.

According to the second scheme, actual rotating speed Ne of the engine 14 is detected first, and then, an actual inclination angle β r, in the up-down direction, of the chute angle 72 is detected. A particular snow throwing distance map indicative of relationship between values of the inclination angle β r, in the up-down direction, of the chute angle 72, which corresponds to the actual rotating speed Ne, is selected from among the snow throwing distance maps for individual rotating speed of the engine 14. Last, a value of the snow throwing distance Lr which corresponds to the actual inclination angle β r is obtained using the selected snow throwing distance map.

Figure 12:
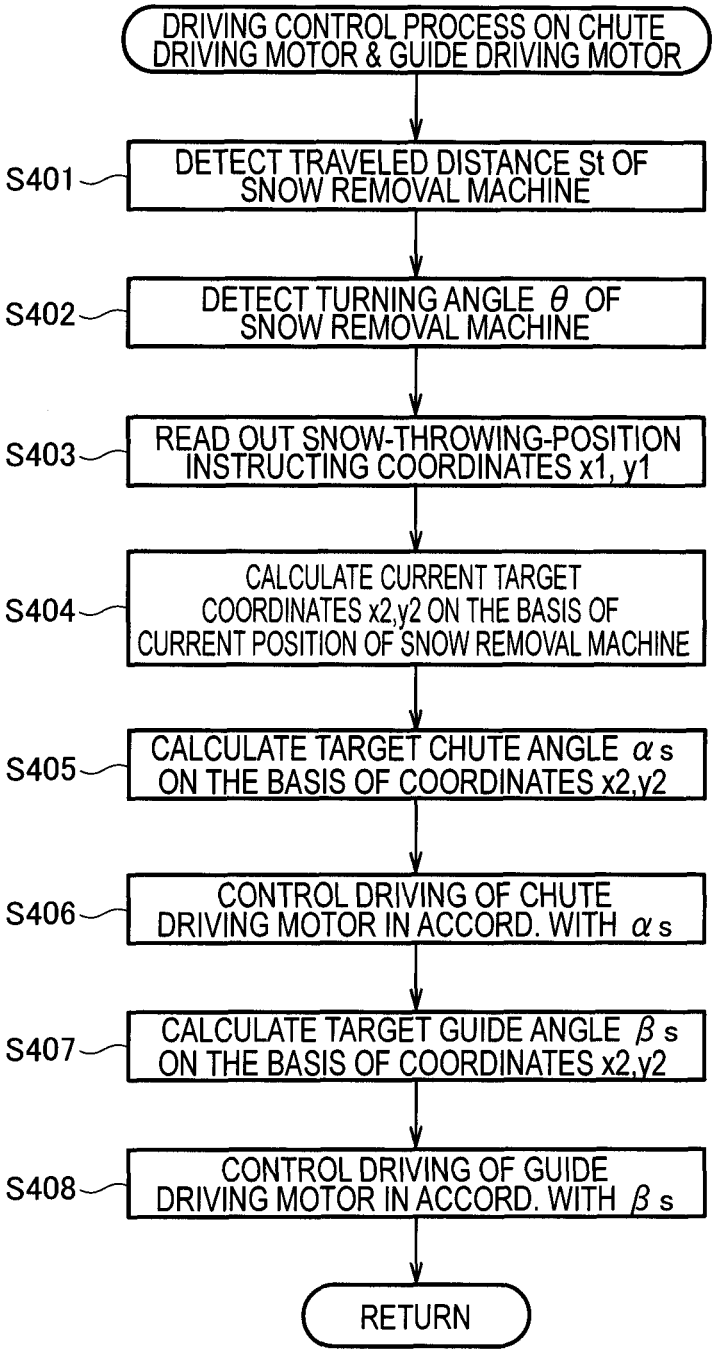
FIG. 12 is a detailed control flow chart of step S111 shown in FIG. 8.

Further, the following describe, with reference to FIG. 12, a detailed control flow for performing a drive control process on the chute driving motor 74*a* and the guide driving motor 75*a*. FIG. 12 is a flow chart showing a subroutine for the control section 61 to perform the "driving control process on the chute driving motor 74*a* and the guide driving motor 75*a*" at step S111 shown in FIG. 9.

First, at step S401 of FIG. 12, the control section 61 detects a traveled distance St of the snow removal machine 10 by means of the traveled distance sensor 79. Then, at step S402, the control section 61 detects a turning angle θ of the snow removal machine 10 by means of the turning angle sensor 65. At next step S403, the control section 61 reads out the snow-throwing-position instructing coordinates x1,y1 from the memory 63. Then, at step S404, the control section 61 evaluates a current point P2 of the chute 71 of the snow removal machine 10 (moved-to point P2 shown in FIG. 5(*b*)) on the basis of values of the traveled distance St and the turning angle θ, but also calculates current snow-throwing-position instructing coordinates x2,y2 on the basis of the current point P2 of the chute 71.

Then, at step S405, the control section 61 calculates a target chute angle α s of the chute 71 on the basis of the current snow-throwing-position instructing coordinates x2,y2. At step S406, the control section 61 controls driving of the chute driving motor 74*a* in accordance with the target chute angle α s. Then, at step S407, the control section 61 calculates a target guide angle β s of the chute guide 72 on the basis of the current snow-throwing-position instructing coordinates x2,y2. Last, at step S408, the control section 61 controls driving of the guide driving motor 75*a* in accordance with the target guide angle β s, after which it ends the driving control process on the chute driving motor 74*a* and the guide driving motor 75*a*.

In the aforementioned manner, the control section 61 can control the snow-throwing drive section 73 to adjust snow throwing directions α r and β r of the snow throwing section 33 on the basis of detection values of the snow throwing directions of α r and β r detected by the snow throwing direction sensor 76 and the inclination angles θ h and θ r.

Namely, the control section 61 can (1) control the chute drive section 74 to adjust the pivoting angle α r of the chute 71 on the basis of detection values of the pivoting angle α r of the chute 71 detected by the chute angle sensor 77 and the inclination angles θ h and θ r detected by the snow removal machine inclination angle detection section 64, and (2) control the guide drive section 75 to adjust the inclination angle β r, in the up-down pivoting direction, of the chute guide 72 on the basis of detection values of the inclination angle β r, in the up-down pivoting direction, of the chute guide 72 detected by the guide angle sensor 78 and the inclination angles θ h and θ r detected by the inclination angle detection section 64.

Second Embodiment

Next, a description will be given about a second embodiment of the snow removal machine of the present invention with reference to FIGS. 13 to 17, of which FIG. 13 corresponds to FIG. 1, FIG. 14 corresponds to FIG. 2 and FIG. 15 corresponds to FIG. 4.

Figure 13:
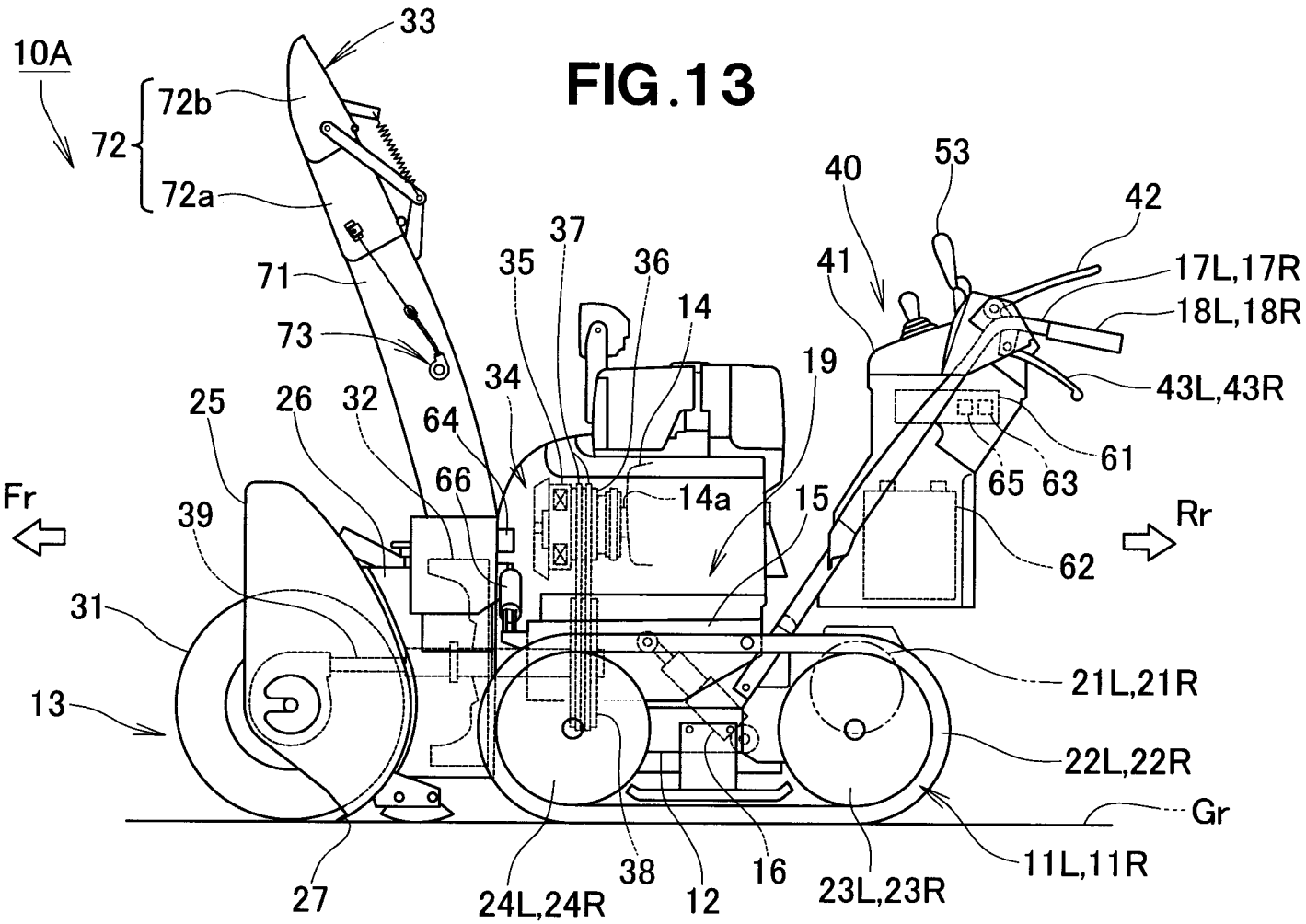
FIG. 13 is a side view showing a second embodiment of the snow removal machine of the present invention.

The second embodiment of the snow removal machine 10A of the present invention shown in FIG. 13 is different from the first embodiment of the snow removal machine 10 of the present invention shown in FIG. 1 in that the snow removal work section 13 in the second embodiment is movably mounted to the travel unit frame 12 and in that the snow removal machine inclination angle sensor 64 in the second embodiment is located on the auger housing 25 or the blower case 26. The other structural features of the second embodiment of the snow removal machine 10A are the same as in the first embodiment of the snow removal machine 10 shown in FIGS. 1 to 12 and thus will not be described to avoid unnecessary duplication.

More specifically, a vehicle body frame 15 is mounted at its rear portion to the travel unit frame 12 in such a manner that it is pivotable in the up-down direction relative to the travel unit frame 12. The vehicle body frame 15 is mounted at its front portion to the travel unit frame 12 in such a manner that it is movable up and down (pivotable in the up-down direction) relative to the travel unit frame 12 by means of an up-down drive mechanism 16. The up-down drive mechanism 16 is vertically pivotably connected at its one end to the travel unit frame 12 in such a manner that it is pivotable in the up-down direction relative to the travel unit frame 12, and the up-down drive mechanism 16 is also vertically pivotably connected at the other end to the vehicle body frame 15. A combination of the travel unit frame 12 and the vehicle body frame 15 constitutes a machine body 19. The vehicle body frame 15 has the snow removal work section 13 and the engine 14 mounted thereon.

The blower case 26 is mounted to the front end of the vehicle body frame 15 in such a manner that it is rotatable in clockwise and counterclockwise directions. The rotation shaft 39 of the snow removing power transmission mechanism 34 extends in the front-rear direction through the rotation axis of the blower case 26. The vehicle body frame 15 is mounted to the travel unit frame 12 as noted above. Thus, the auger housing 25 and the blower case 26 are mounted to the travel unit frame 12 in such a manner that they are rollable relative to the travel unit frame 12. As a consequence, the auger housing 25 is movable up and down and rollable relative to the auger housing 25.

The auger housing 25 and the blower case 26 can be driven to roll by means of a rolling drive mechanism 66 that is an actuator having a piston movable in and out of a cylinder. The rolling drive mechanism 66 is mounted at one end to the vehicle body frame 15 in such a manner that it is pivotable in the left-right direction relative to the vehicle body frame 15, while the rolling drive mechanism 66 is mounted at the other end to the rear surface of the blower case 26 in such a manner that it is pivotable in the left-right direction relative to the rear surface of the blower case 26.

In the second embodiment, the auger housing 25 or the blower case 26 can be placed in a horizontal posture irrespective of an inclination of the travel unit frame 12. The snow removal machine angle sensor 64 is mounted on the auger housing 25 or the blower case 26. Referring also to FIGS. 6 and 7, an inclination angle θ h in the front-rear direction and an inclination angle θ r in the left-right direction of the snow removal work section 13 can be detected by the snow removal machine angle sensor 64. Namely, inclination angles θ h and θ r of the snow throwing section 33 relative to the horizontal surface Gh (see FIG. 6) can be detected by the snow removal machine angle sensor 64. Thus, inclination angles θ h and θ r of the snow throwing section 33 can be accurately evaluated irrespective of an inclination of the travel unit frame 12.

Figure 14:
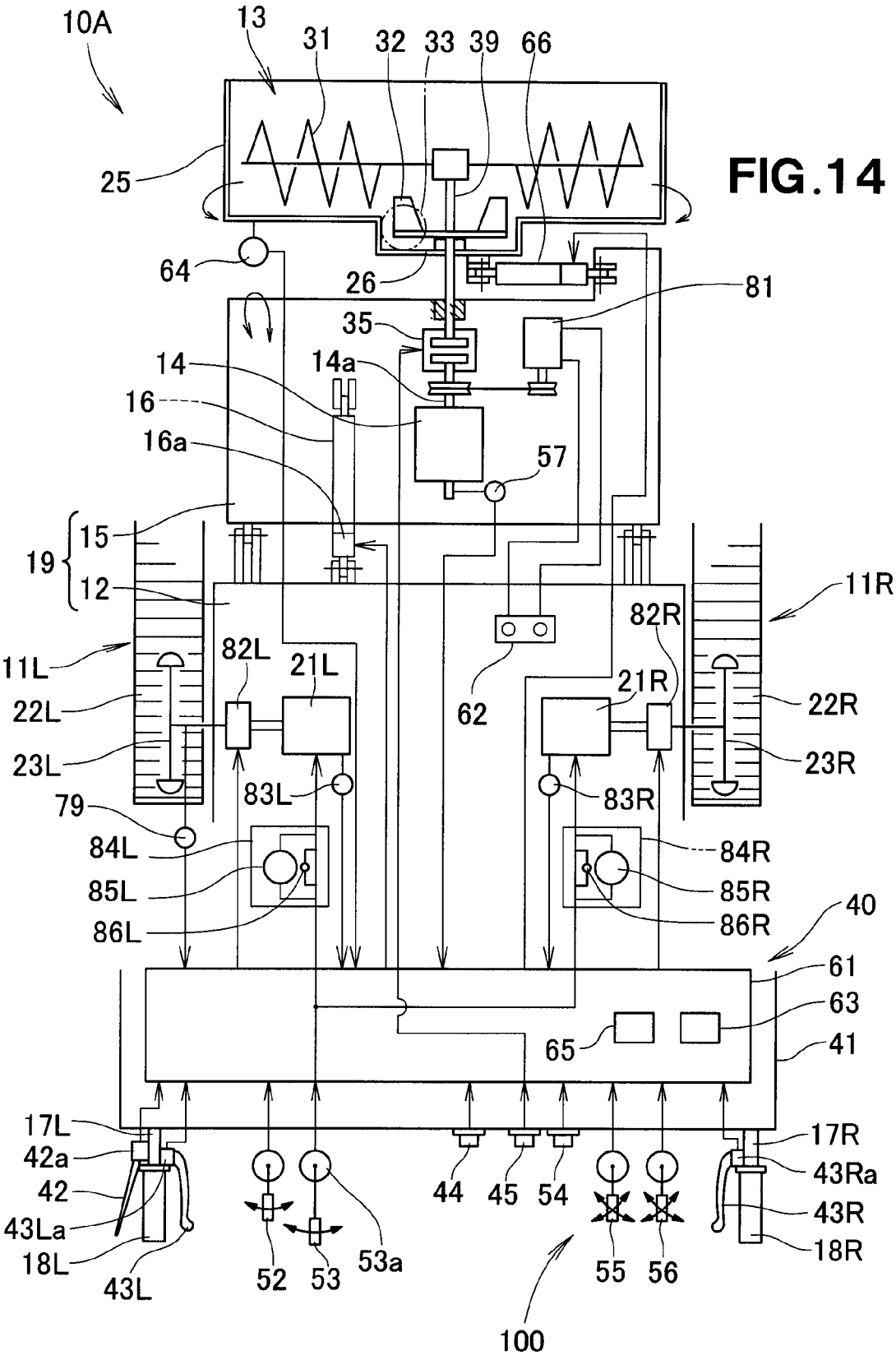
FIG. 14 is a schematic plan view of the second embodiment of the snow removal machine of FIG. 13, which particularly shows a control system of the snow removal machine.
Figure 15:
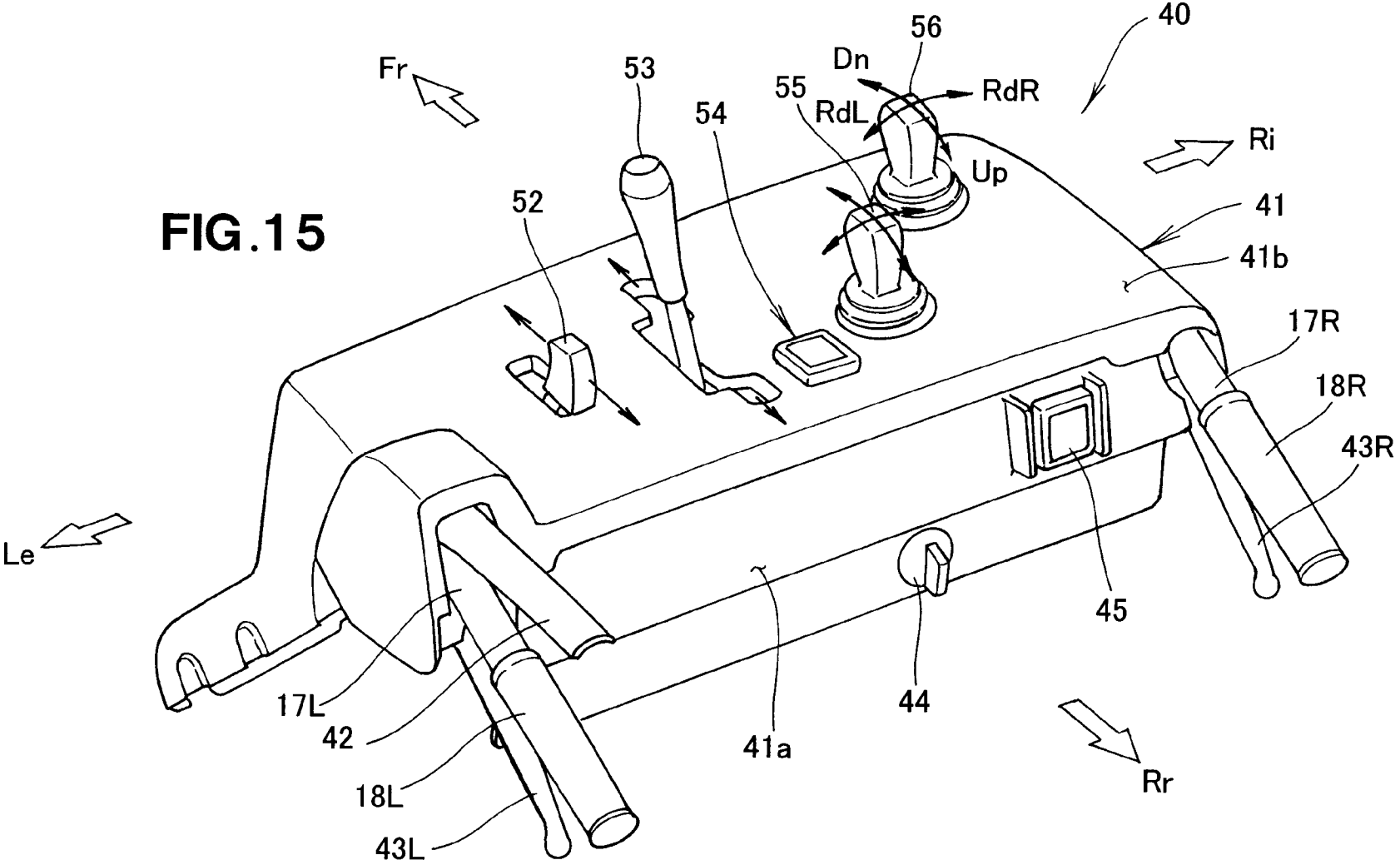
FIG. 15 is a rear upper perspective view of an operation section shown in FIG. 13.

Further, as shown in FIGS. 13 to 15, an auger-housing-posture operating lever 55 is provided on the upper surface 41*b* of the operation box 41, so that the posture of the auger housing 25 can be changed via the auger-housing-posture operating lever 55. Namely, the auger-housing-posture operating lever 55 is an operation member for operating or manipulating the up-down drive mechanism 16 and the rolling drive mechanism 66 in such a manner that the auger housing 25 is movable up or down and rollable in accordance with the surface of snow.

In response to the auger-housing-posture operating lever 55 being pivoted in the front-rear direction, the piston of the up-down drive mechanism 16 is extendable and retractable so that the auger housing 25 and the blower case 26 move up and down. Further, in response to the auger-housing-posture operating lever 55 being pivoted leftward and rightward, a piston of the rolling drive mechanism 66 is extendable and retractable so that the auger housing 25 and the blower case 26 roll clockwise and counterclockwise.

Figure 16:
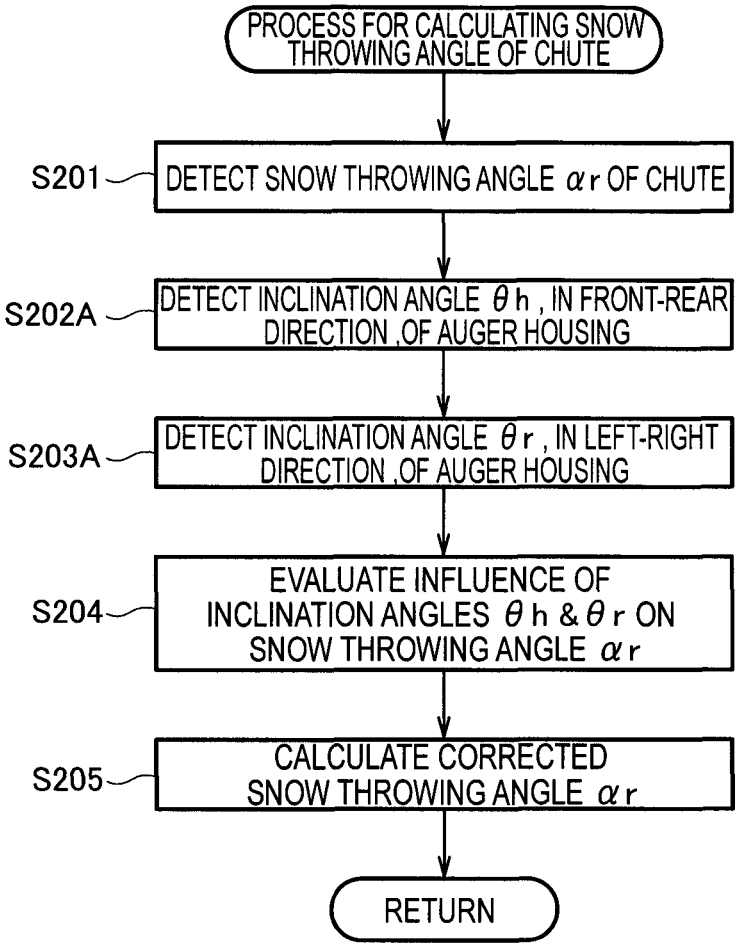
FIG. 16 is a control flow chart explanatory of a process performed by a control section of FIG. 14 for calculating a snow throwing angle of a chute.

FIG. 16 is a flow chart, corresponding to FIG. 10, which shows a subroutine for the control section 61 to perform in the second embodiment the "process for calculating a snow throwing angle α r of the chute 71" at step S101 shown in FIG. 9.

At step S202A of FIG. 16, which is a modification of step S202 shown in FIG. 10, the control section 61 detects an inclination angle θ h, in the front-rear direction, of the auger housing 25 and the snow removal work section 13 by means of the snow removal machine inclination angle section 64. At step S203A of FIG. 16, which is a modification of step S203 shown in FIG. 10, the control section 61 detects an inclination angle θ r, in the left-right direction, of the auger housing 25 and the snow removal work section 13 by means of the snow removal machine inclination angle section 64. Steps S201, S204 and S205 are the same as those shown in FIG. 10.

Figure 17:
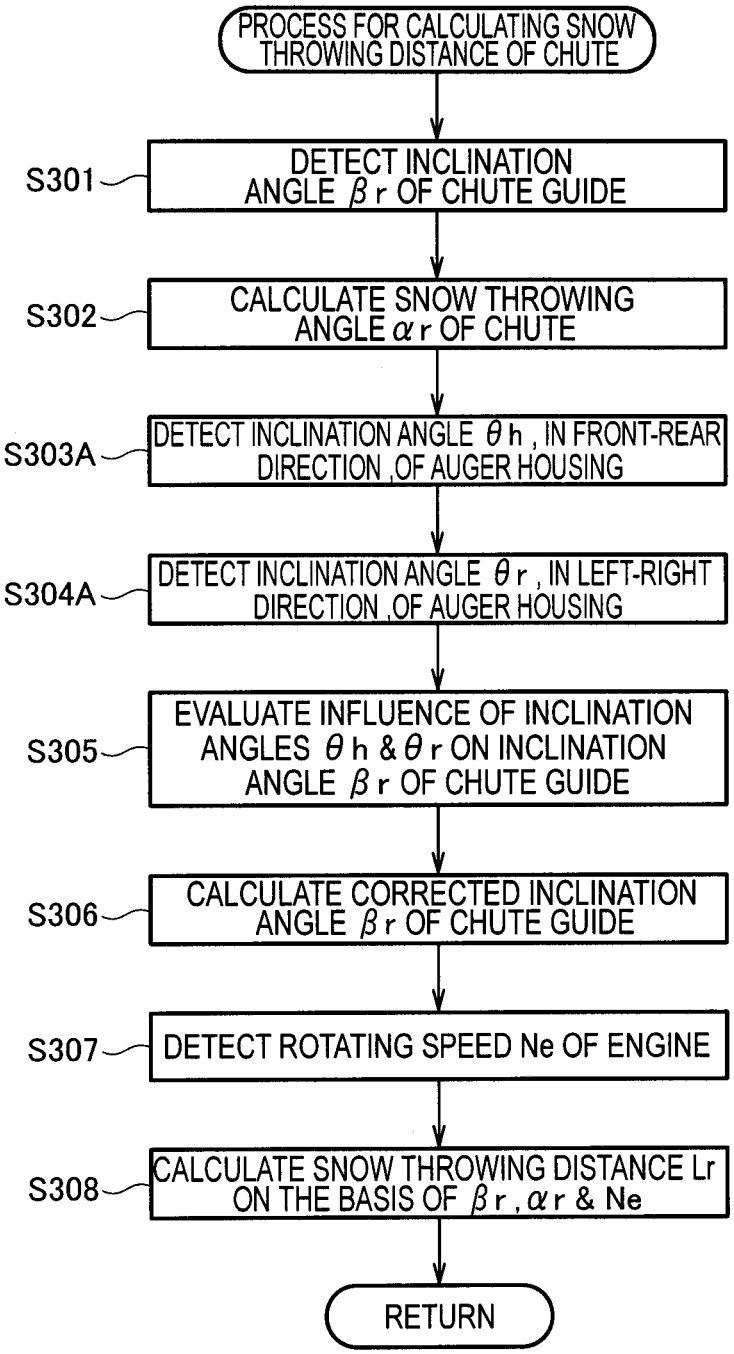
FIG. 17 is a control flow chart explanatory of a process performed by the control section of FIG. 14 for calculating a snow throwing distance of the chute.

Further, FIG. 17 is a flow chart, corresponding to FIG. 11, which shows a subroutine for the control section 61 to perform in the second embodiment the "process for calculating a snow throwing distance Lr of the chute 71" at step S102 shown in FIG. 9.

At step S303A of FIG. 17, which is a modification of step S303 shown in FIG. 11, the control section 61 detects an inclination angle θ h, in the front-rear direction, of the auger housing 25 and the snow removal work section 13 by means of the snow removal machine inclination angle section 64. At step S304A of FIG. 17, which is a modification of step S304 shown in FIG. 11, the control section 61 detects an inclination angle θ r, in the left-right direction, of the auger housing 25 and the snow removal work section 13 by means of the snow removal machine inclination angle section 64. Steps S301, S302 and S305 to S308 of FIG. 17 are the same as those shown in FIG. 11.

In the second embodiment constructed as above, the inclination angles θ h and θ r of the snow throwing section 33 can be obtained appropriately irrespective of an inclination of the travel unit frame 12. Thus, the control section 61 can control the snow-throwing drive section 73 to adjust snow throwing directions α r and β r of the snow throwing section 33 on the basis of detection values of the snow throwing directions of α r and β r detected by the snow throwing direction sensor 76 and the inclination angles θ h and θ r detected by the snow removal machine inclination angle sensor 64.

Namely, the control section 61 can (1) control the chute drive section 74 to adjust the pivoting angle α r of the chute 71 on the basis of detection values of the pivoting angle α r of the chute 71 detected by the chute angle sensor 77 and the inclination angles θ h and θ r detected by the snow removal machine inclination angle detection section 64, and (2) control the guide drive section 75 to adjust the inclination angle β r, in the up-down pivoting direction, of the chute guide 72 on the basis of detection values of the inclination angle β r, in the up-down direction, of the chute guide 72 detected by the guide angle sensor 78 and the inclination angles θ h and θ r detected by the snow removal machine inclination angle sensor 64.

Third Embodiment

Next, a description will be given about a third embodiment of the snow removal machine of the present invention with reference to FIGS. 18 to 20, of which FIG. 18 corresponds to FIG. 14.

Figure 18:
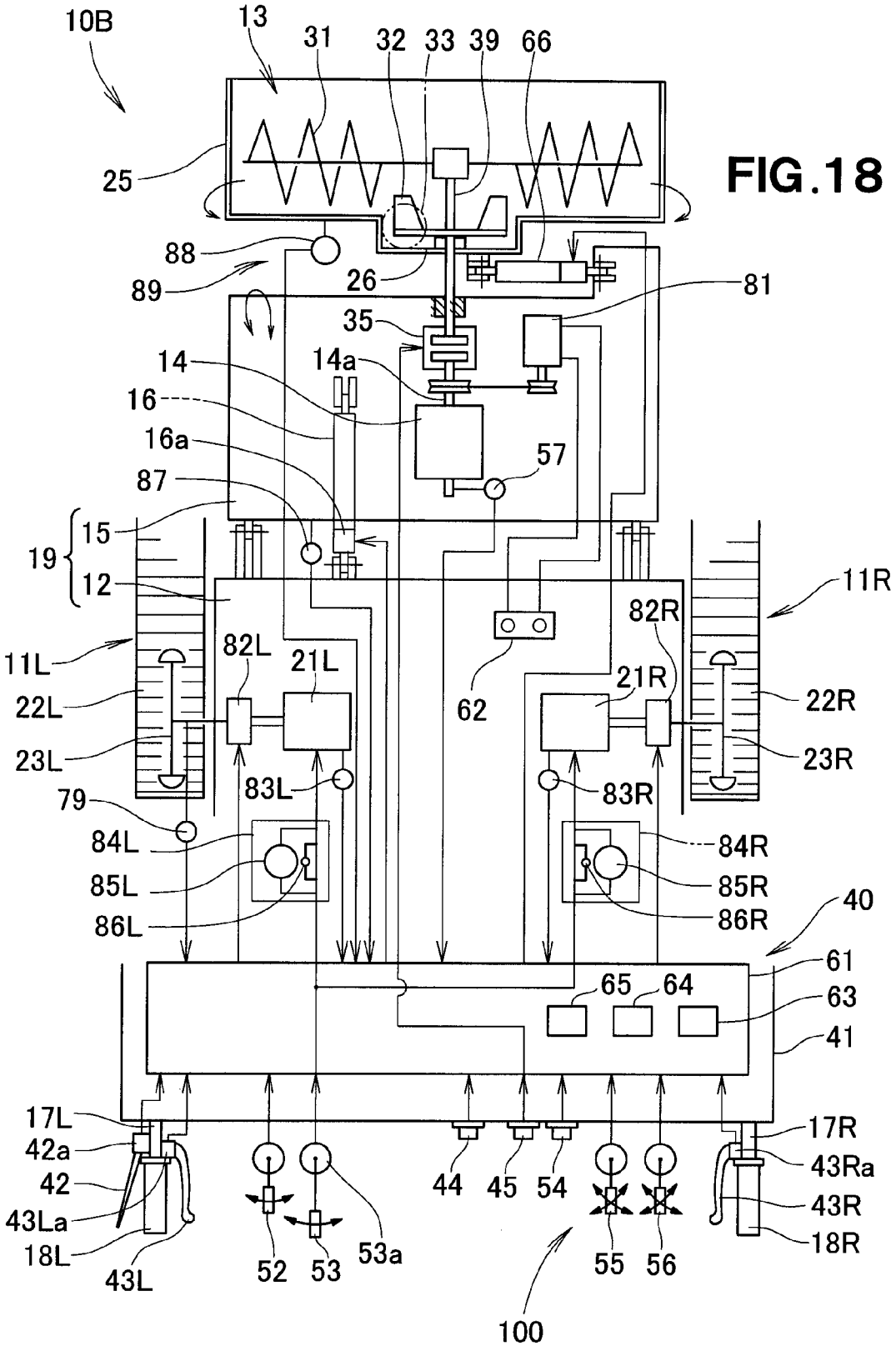
FIG. 18 is a schematic plan view of a third embodiment of the snow removal machine of the present invention, which particularly shows a control system of the snow removal machine.

The third embodiment of the snow removal machine 10B of the present invention shown in FIG. 18 is different from the above-described second embodiment of the snow removal machine 10A of the present invention shown in FIG. 13 in that the snow removal machine inclination angle sensor 64 is built in or provided in the control section 61 as in the first embodiment or mounted on the travel unit frame 12, and in that a height position sensor 87 and a rolling position sensor 88 are added. The other structural features of the third embodiment of the snow removal machine 10B are based on the construction of the first embodiment and generally the same as some of the structural features of the second embodiment and thus will not be described here to avoid unnecessary duplication.

Further, as shown in FIG. 18, the height position sensor 87, which is for example in the form of a waterproof rotary potentiometer, is constructed to detect an inclination angle ϕ h (auger height inclination angle ϕ h), in the up-down direction, of the auger housing 25 and the snow removal machine work section 13 relative to the travel unit frame 12, i.e. detect a position in the up-down direction (or up-down position) of the auger housing 25. The height position sensor 87 is mounted to a portion of the snow removal machine 10B that does not roll together with the auger housing 25; that is, the height position sensor 87 is mounted on the vehicle body frame 15 (i.e., a part of the machine body 19).

The rolling position sensor 88, which is for example in the form of a waterproof rotary potentiometer, is constructed to detect an inclination angle ϕ r (auger rolling inclination angle ϕ 6), in the left-right direction, of the auger housing 25 and the snow removal machine work section 13 relative to the vehicle body frame 15, i.e. detect a rolling position of the auger housing 25. The following may be said in view of the foregoing. Namely, the vehicle body frame 15 would not incline in the left-right direction relative to the travel unit frame 12. Thus, the rolling position sensor 88 can be said to detect an inclination angle $\phi$ r (auger rolling inclination angle $\phi$ 6), in the left-right direction, of the auger housing 25 and the snow removal machine work section 13 relative to the travel unit frame 12. The rolling position sensor 88 is mounted on the auger housing 25 or the blower case 26.

An inclination angle $\theta$ h, in the front-rear direction, of the snow throwing section 33 relative to the horizontal surface Gh (see FIG. 6) can be detected (or evaluated) on the basis of detection values of the frame inclination angle detection section 64 and the height position sensor 87. Further, an inclination angle $\theta$ r, in the left-right direction, of the snow throwing section 33 relative to the horizontal surface Gh can be detected (or evaluated) on the basis of detection values of the frame inclination angle detection section 64 and the rolling position sensor 88. Thus, in the third embodiment, a combination of the frame inclination angle detection section 64, the height position sensor 87 and the rolling position sensor 88 constitutes a snow removal machine inclination angle sensor 89. Namely, the inclination angles $\theta$ h and $\theta$ r of the snow throwing section 33 relative to the horizontal surface Gh can be detected by the snow removal machine inclination angle sensor 89. Thus, the inclination angles $\theta$ h and $\theta$ r of the snow throwing section 33 can be evaluated irrespective of an inclination of the travel unit frame 12.

Figure 19:
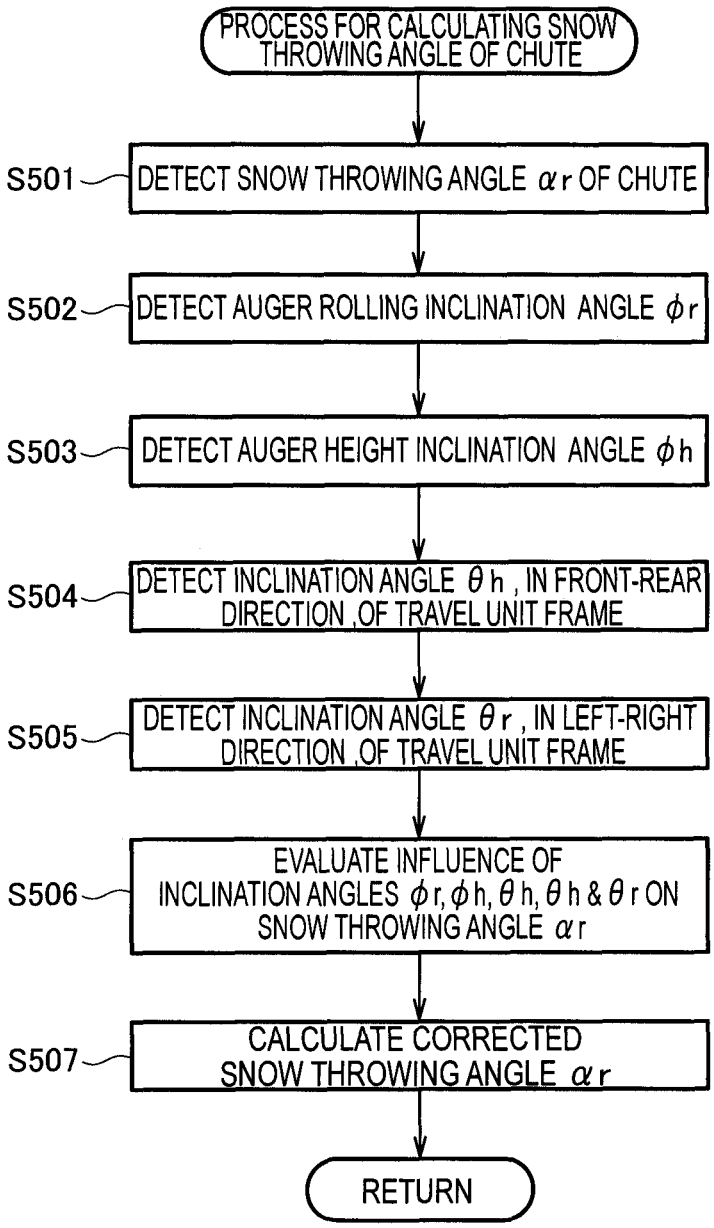
FIG. 19 is a control flow chart explanatory of a process performed by a control section of FIG. 18 for calculating a snow throwing angle of the chute.

FIG. 19 is a flow chart, corresponding to FIG. 16, which shows a subroutine for the control section 61 to perform in the third embodiment the "process for calculating a snow throwing angle $\alpha$ r of the chute 71" at step S101 shown in FIG. 9.

More specifically, first, at step S501, the control section 61 detects a snow throwing angle $\alpha$ r of the chute 71 by means of the chute angle sensor 77. Then, at step S502, the control section 61 detects an auger rolling inclination angle $\phi$ r by means of the rolling position sensor 88. At next step S503, the control section 61 detects an auger height inclination angle $\phi$ h of the auger housing 25 by means of the height position sensor 87. Then, at step S504, the control section 61 detects an inclination angle $\theta$ h, in the front-rear direction, of the travel unit frame 12 by means of the frame inclination angle detection section 64. At next step S505, the control section 61 detects an inclination angle $\theta$ r, in the left-right direction, of the travel unit frame 12 by means of the frame inclination angle detection section 64.

Then, at step S506, the control section 61 evaluates influence of the individual inclination angles $\phi$ r, $\phi$ h, $\theta$ h and $\theta$ r on the snow throwing angle $\alpha$ r of the chute 71. The greater the inclination angles $\phi$ r, $\phi$ h, $\theta$ h and $\theta$ r, the more the snow throwing angle $\alpha$ r of the chute 71 is influenced. Thus, there arises a need for correcting the snow throwing angle $\alpha$ r of the chute 71 by an amount corresponding to the evaluated influence.

Next, at step S507, the control section 61 calculates a corrected snow throwing angle $\alpha$ r of the chute 71 by correcting the detected snow throwing angle $\alpha$ r with the amount corresponding to the influence (correction value) evaluated at step S506 above, after which it ends the subroutine process for calculating a snow throwing angle $\alpha$ r of the chute 71.

Figure 20:
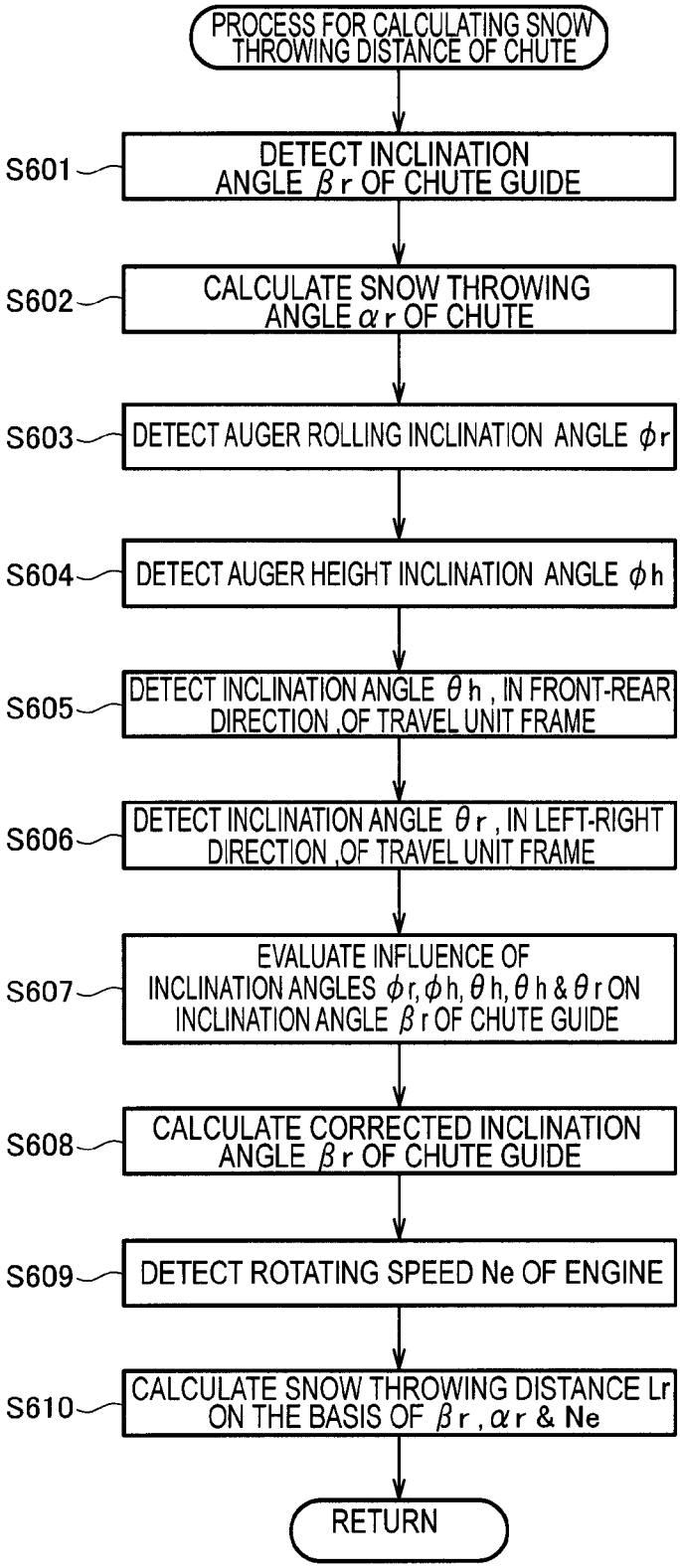
FIG. 20 is a control flow chart explanatory of a process performed by the control section of FIG. 18 for calculating a snow throwing distance of the chute.

FIG. 20 is a flow chart, corresponding to FIG. 17, which shows a subroutine for the control section 61 to perform in the third embodiment the process for calculating a snow throwing distance Lr of the chute 71 at step S102 shown in FIG. 9.

First, at step S601 of FIG. 20, the control section 61 detects an inclination angle $\beta$ r, in the up-down direction, of the chute guide 72 by means of the guide angle sensor 78. At next step S602, the control section 61 detects a snow throwing angle $\alpha$ r of the chute 71 by means of the chute angle sensor 77.

Then, at step S603, the control section 61 detects an auger rolling inclination angle $\phi$ r of the auger housing 25 by means of the rolling position sensor 88. At next step S604, the control section 61 detects an auger height inclination angle $\phi$ h of the auger housing 25 by means of the height position sensor 87.

Then, at step S605, the control section 61 detects an inclination angle $\theta$ h, in the front-rear direction, of the travel unit frame 12 by means of the frame inclination angle detection section 64. At next step S606, the control section 61 detects an inclination angle $\theta$ r, in the left-right direction, of the travel unit frame 12 by means of the frame inclination angle detection section 64.

Then, at step S607, the control section 61 evaluates influence of the individual inclination angles $\phi$ r, $\theta$ h and $\theta$ r on the inclination angle $\beta$ r, in up-down direction, of the chute guide 72. The greater the inclination angles $\phi$ r, $\theta$ h and $\theta$ r, the more the inclination angle $\beta$ r $\alpha$ r of the chute guide 72 is influenced. Thus, there arises a need for correcting the inclination angle $\beta$ r of the chute guide 72 by an amount corresponding to the evaluated influence.

Next, at step S608, the control section 61 calculates a corrected inclination angle $\beta$ r of the chute guide 72 by correcting the detected inclination angle $\beta$ r with the amount corresponding to the influence (correction value) evaluated at step S607 above. Then, at step S609, the control section 61 detects rotating speed Ne of the engine 14 by means of the engine speed sensor 57.

Then, at step S610, the control section 61 calculates a snow throwing distance Lr of the chute 71 on the basis of the inclination angle $\beta$ r, in the up-down direction, of the chute guide 72, the snow throwing angle $\alpha$ r (snow throwing direction) of the chute 71 and the rotating speed Ne of the engine 14, after which the control section 61 ends the instant subroutine process for calculating a snow throwing distance Lr of the chute 71. The same schemes as employed at step S308 of FIG. 17 in relation to the first embodiment may be employed for calculating a snow throwing distance Lr of the chute 71 on the basis of the inclination angle $\beta$ r, in the up-down direction, of the chute guide 72.

In the third embodiment, like in the second embodiment, inclination angles $\theta$ h and $\theta$ r of the snow throwing section 33 can be evaluated irrespective of an inclination of the travel unit frame 12. Thus, the control section 61 can control the snow-throwing drive section 73 to adjust snow throwing directions $\alpha$ r and $\beta$ r of the snow throwing section 33 on the basis of detection values of the snow throwing directions of $\alpha$ r and $\beta$ r detected by the snow throwing direction sensor 76 and the inclination angles $\theta$ h and $\theta$ r detected by the snow removal machine inclination angle sensor 64.

The foregoing description may be summarized as follows. In each of the first, second and third embodiments, the control section 61 controls the snow-throwing drive section 73 to adjust the snow throwing directions $\alpha$ r and $\beta$ r of the snow throwing section 33 on the basis of detection values of the snow throwing direction sensor 76 and the frame inclination angle detection section 64. Thus, the snow throwing directions $\alpha$ r and $\beta$ r of the snow throwing section 33 can be automatically corrected on the basis of inclination angles of the snow removal machine 10, 10A or 10B itself detected by the frame inclination angle detection section 64. In this manner, the snow throwing directions α r and β r of the snow throwing section 33 can be automatically adjusted in accordance with topographical variation of an area where snow removal work is to be performed. Thus, in a case where thrown snow is to be gathered in one place by automatically adjusting the snow throwing directions α r and β r of the snow throwing section 33 in accordance with a traveled distance Lr of the snow removal machine 10, 10A or 10B, the thrown snow can be gathered in one place. In this way, the present invention can effectively alleviate a burden on the human operator.

As a modification of the present invention, only one of the left and right travel units 11L and 11R may be provided on the travel unit frame 12. Further, the left and right travel units 11L and 11R may comprise wheels rather than crawlers. Furthermore, both the left and right travel units 11L and 11R and the snow removal work section 13 may be driven by a same drive source. For example, both the left and right travel units 11L and 11R and the snow removal work section 13 may be driven by the engine 14.

Finally, the basic principles of the present invention are well suited for application to auger type snow removal machines where at least the auger is driven by an engine.

What is claimed is:

1. A snow removal machine configured to adjust a snow throwing direction of a snow throwing section using a snow throwing drive section, comprising:

a snow throwing direction sensor for detecting a first inclination angle in an up-down direction and a pivoting angle of the snow throwing section as a snow throwing direction of the snow throwing section;

a snow removal machine inclination angle sensor for detecting a second inclination angle of the snow removal machine or the snow throwing section of the snow removal machine relative to a horizontal surface; and a control section that controls the snow throwing drive section to adjust the snow throwing direction of the snow throwing section based on respective detection values of the snow throwing direction detected by the snow throwing direction sensor and the second inclination angle detected by the snow removal machine inclination angle sensor.

2. The snow removal machine according to claim 1, wherein the snow throwing drive section comprises a chute guide pivotable in the up-down direction for adjusting a snow throwing angle in the up-down direction, the snow throwing drive section comprises a guide drive section for pivotally driving the chute guide in the up-down direction, the snow throwing direction sensor comprises a guide angle sensor for detecting an inclination angle of the chute guide in the up-down direction as the first inclination angle, and the control section controls the guide drive section to adjust the inclination angle of the chute guide in the up-down direction based on respective detection values of the inclination angle of the chute guide in the up-down direction detected by the guide angle sensor and the second inclination angle detected by the snow removal machine inclination angle sensor.

3. The snow removal machine according to claim 1, wherein the snow throwing section comprises a chute pivotable for adjusting the snow throwing direction, the snow throwing drive section comprises a chute drive section for pivotally driving the chute, the snow throwing direction sensor comprises a chute angle sensor for detecting a pivoting angle of the chute as the pivoting angle of the snow throwing section, and the control section controls the chute drive section to adjust the pivoting angle of the chute based on respective detection values of the pivoting angle of the chute detected by the chute angle sensor and the second inclination angle detected by the snow removal machine inclination angle sensor.

4. The snow removal machine according to claim 3, wherein the chute is pivotable to adjust the snow throwing direction in a horizontal direction, the horizontal direction being along a horizontal plane substantially parallel to the horizontal surface, and the horizontal direction being substantially perpendicular to the up-down direction, the chute drive section is for pivotally driving the chute to adjust the snow throwing direction in the horizontal direction, and the chute angle sensor is for detecting the pivoting angle of the chute in the horizontal direction.

5. The snow removal machine according to claim 3, wherein the chute is pivotable to adjust the snow throwing direction in a horizontal direction, the horizontal direction being along a horizontal plane substantially parallel to the horizontal surface, and the horizontal direction being substantially perpendicular to the up-down direction, the chute drive section is for pivotally driving the chute to adjust the snow throwing direction in the horizontal direction, and the chute angle sensor is for detecting the pivoting angle of the chute in the horizontal direction.

6. The snow removal machine according to claim 1, wherein the snow throwing section comprises a chute and a chute guide which are pivotable for adjusting the snow throwing direction, the snow throwing drive section comprises a chute drive section for pivotally driving the chute, and a guide drive section for pivotally driving the chute guide, the snow throwing direction sensor comprises a chute angle sensor for detecting a pivoting angle of the chute as the pivoting angle of the snow throwing section, and a guide angle sensor for detecting an inclination angle of the chute guide in the up-down direction, as the first inclination angle, and the control section both: controls the chute drive section to adjust the pivoting angle of the chute based on respective detection values of the pivoting angle of the chute detected by the chute angle sensor and the second inclination angle detected by the snow removal machine inclination angle sensor; and controls the guide drive section to adjust the inclination angle of the chute guide in the up-down direction based on respective detection values of the inclination angle of the chute guide in the up-down direction detected by the guide angle sensor and the second inclination angle detected by the snow removal machine inclination angle sensor.

7. The snow removal machine according to claim 1, wherein the pivoting angle of the snow throwing section controls the snow throwing direction of the snow throwing section in a horizontal direction, the horizontal direction being along a horizontal plane substantially parallel to the horizontal surface, and the horizontal direction being substantially perpendicular to the up-down direction.

* * * * *